US005329811A

United States Patent [19]

Schultz et al.

[11] Patent Number: 5,329,811

[45] Date of Patent: Jul. 19, 1994

[54] DOWNHOLE FLUID PROPERTY MEASUREMENT TOOL

[75] Inventors: Roger L. Schultz, Richardson; William L. Bohan, Garland, both of Tex.

[73] Assignee: Halliburton Company, Houston, Tex.

[21] Appl. No.: 13,591

[22] Filed: Feb. 4, 1993

[51] Int. Cl.[5] ..... E21B 47/06; E21B 49/08; G01N 7/14; G01N 33/28

[52] U.S. Cl. ..... 73/155; 73/19.10; 73/152; 166/250; 166/264

[58] Field of Search ..... 73/152, 155, 19.01, 73/19.05, 19.10, 153; 160/250, 264; 175/48

[56] References Cited

U.S. PATENT DOCUMENTS

| | | | |
|---|---|---|---|
| 2,138,141 | 11/1938 | Cromer et al. | 73/19 |
| 2,607,222 | 8/1952 | Lane | 73/155 |
| 3,060,722 | 10/1962 | Migdal et al. | 73/19.05 |
| 3,079,793 | 3/1963 | Le Bus et al. | 73/152 |
| 3,203,247 | 8/1965 | Bicek | 73/864.91 |
| 3,233,674 | 2/1966 | Leutwyler | 166/63 |
| 3,577,781 | 5/1971 | Lebourg | 73/152 |
| 3,577,783 | 5/1971 | Whitten | 73/152 |
| 3,731,530 | 5/1973 | Tanguy et al. | 73/153 |
| 3,780,575 | 12/1973 | Urbanosky | 73/152 |
| 3,802,260 | 4/1974 | Kishel | 73/153 |
| 3,826,133 | 7/1974 | Nicolas et al. | 73/152 |
| 3,864,970 | 2/1975 | Bell | 73/155 |
| 3,937,060 | 2/1976 | Lewis et al. | 73/19.05 |
| 4,078,620 | 3/1978 | Westlake et al. | 175/48 |
| 4,210,025 | 7/1980 | Bimond et al. | 73/155 |
| 4,255,088 | 3/1981 | Newton et al. | 73/19.01 |
| 4,347,900 | 9/1982 | Barrington | 166/380 |
| 4,375,239 | 3/1983 | Barrington et al. | 166/336 |
| 4,378,850 | 4/1983 | Barrington | 166/373 |
| 4,468,665 | 8/1984 | Thawley et al. | 340/856 |
| 4,573,532 | 3/1986 | Blake | 166/264 |
| 4,583;595 | 4/1986 | Czernichow et al. | 166/264 |
| 4,635,717 | 1/1987 | Jageler | 166/250 |
| 4,700,561 | 10/1987 | Dougherty | 73/19.05 |
| 4,712,613 | 12/1987 | Nieuwstad | 166/53 |
| 4,766,955 | 8/1988 | Petermann | 166/167 |
| 4,782,695 | 11/1988 | Glotin et al. | 73/155 |
| 4,860,580 | 8/1989 | DuRocher | 73/155 |
| 4,862,729 | 9/1989 | Toda et al. | 73/19.05 |
| 4,866,607 | 9/1989 | Anderson et al. | 364/422 |
| 5,220,513 | 6/1993 | Seiden et al. | 73/19.01 |

FOREIGN PATENT DOCUMENTS 129584 12/1959 U.S.S.R. .

OTHER PUBLICATIONS

"A Course in the Phase Behavior of Hydrocarbon Reservoir Fluids", Chapters II.A, B and C, printed course materials of Core Laboratories (undated but admitted to be prior art).

*Primary Examiner*—Hezron E. Williams
*Assistant Examiner*—George M. Dombroske
*Attorney, Agent, or Firm*—Tracy W. Druce; Lucian Wayne Beavers

[57] ABSTRACT

Apparatus and methods are provided for measuring a parameter of a hydrocarbon-bearing well fluid sample while the sample is still in place in the well and at downhole pressure and temperature conditions. A tool is lowered into the well to a downhole location. A well fluid sample is trapped in the tool at the downhole location. While the tool remains within the well, the volume of the well fluid sample is expanded while repeatedly measuring the pressure of the trapped well fluid sample at different volumes and thereby generating pressure versus volume data for the trapped well fluid sample. From this data, various parameters such as bubble-point pressure and compressibility of the sample can be readily obtained. The apparatus is suited for drawing and testing multiple samples in succession. After each sample is tested, it is expelled from the tool so that another sample can be taken. The data can be stored for subsequent analysis at the surface or it can be transmitted to the surface for real time analysis.

26 Claims, 12 Drawing Sheets

DOWNHOLE FLUID PROPERTY MEASUREMENT TOOL

BACKGROUND OF THE INVENTION

1. Field of the Invention

The present invention relates generally to apparatus for measuring downhole the properties of a hydrocarbon-bearing fluid, and more particularly, but not by way of limitation, to an apparatus capable of making multiple downhole measurements without being removed from the well.

2. Brief Description of the Prior Art

It is often desirable in well testing operations to retrieve downhole fluid samples for inspection and analysis. One portion of the lab analysis which is usually performed on a sample is a determination of the physical properties of a sample. One of the properties which must be determined is the pressure below which the gas present in an oil sample will begin to leave the single-phase oil sample and break out of solution, creating a two-phase oil and gas sample.

This pressure is dependent on the temperature of the sample, and is known as the bubble-point pressure. The bubble-point pressure of a sample is determined by placing the sample into a laboratory cell where the heat and pressure can be controlled. In some cases, a crude bubble-point determination is made at the well site, at ambient conditions. The determined value of the bubble point at ambient conditions is then used to extrapolate or predict the bubble point at downhole temperatures.

In any case, the goal is usually to determine the bubble point for the sample at one or more downhole locations by estimating what happens to the sample properties under these conditions or by trying to recreate the downhole conditions.

One problem with present methods of determining bubble point pressure and other sample properties is with the handling of the sample. The sample is captured downhole, then retrieved to the surface. As the sample is retrieved to surface, it cools down and the sample pressure drops. In some samples, irreversible chemical changes occur as the sample cools down. This problem is unavoidable with present methods.

Another problem which can arise with present sampling techniques, is sample degradation due to long-term storage at ambient conditions. It often takes a long time for samples to be shipped from the well site to a lab for analysis.

Human error in the processes described above can also result in sample corruption, contamination or degradation in some other way. Unclean sample bottles, lab equipment, etc., can also degrade the sample.

Thus there is a need for an apparatus which can readily determine the bubble-point pressure and other desired parameters of a well fluid sample downhole within the well while the sample is still at its natural conditions.

SUMMARY OF THE INVENTION

The present invention provides an apparatus which is placed at a downhole location in a well and which directly measures and records the data necessary to determine several properties of the oil in the well. The oil sample is manipulated by changing the volume of a finite sample originally at downhole conditions. The pressure and temperature associated with these changes in volume, as well as the corresponding volume, are measured and recorded for analysis at the surface. Alternatively, the tool can be run on an electric wireline which provides real time communication of the data to the surface. Since this tool performs these tasks at a downhole location, the fluid being analyzed is of very high quality, and the downhole conditions are exact and natural instead of simulated or estimated.

Methods utilizing the present invention include steps of lowering a testing tool to a downhole location in a well, then trapping a well fluid sample in the tool at the downhole location. While the tool remains within the well, the volume of the trapped well fluid sample is expanded and the pressure of the trapped well fluid sample is repeatedly measured at different volumes thereby generating pressure-versus-volume data for the trapped well fluid sample.

From this pressure-versus-volume data, many parameters of the sample can be determined including bubble point pressure and compressibility.

Preferably, the expansion of the sample occurs in incremental steps, and the pressure of the trapped sample is allowed to stabilize prior to expanding the volume by another incremental step.

The tool also permits the trapped sample to be expelled and the process to be repeated so that numerous measurements can be taken at various locations within the well. This allows the entire column of well fluid to be analyzed, and among other things, allows a reliable determination of the depth within the well at which dissolved gas naturally begins to break out of solution from the produced well fluid.

The preferred apparatus for conducting these methods includes an elongated housing having a housing bore defined therein, the housing bore partially defining a sample chamber. The housing has a sample collection passage defined therein communicating the sample chamber with an exterior of the housing.

A piston is slidably disposed in the housing bore so that a volume of the sample chamber may be expanded by movement of the piston in a first direction and so that the volume of the sample chamber may be contracted by movement of the piston in a second direction.

A valve is provided for closing the sample collection passage and trapping a well fluid sample in the sample chamber after the piston has moved in a first direction past a first position.

The valve also allows the reopening of the sample collection passage so that the trapped well fluid sample may be expelled from the sample chamber as the piston moves back in a second direction, thus preparing the apparatus for performing repeated tests.

A sensor is communicated with the sample chamber for sensing parameters of the well fluid such as pressure and temperature.

Many advantages are provided by the tool of the present invention. First, fluid property measurements may be made downhole under optimum conditions while the oil to be analyzed is at its highest pressure and most representative condition before it has undergone substantial pressure or temperature changes.

Additionally many measurements may be made on a single trip of the tool into the well, allowing comparison between sample data to insure valid data.

Fluid property measurements for different locations within the well corresponding to different temperatures present in the well may be made.

Finally, the tool may be used to indicate the state, i.e., whether single or multi-phase, of the well fluid to indicate where the phase change occurs in the well.

Numerous other objects, features and advantages of the present invention will be readily apparent to those skilled in the art upon a reading of the following disclosure when taken in conjunction with accompanying drawings.

DETAILED DESCRIPTION OF THE PREFERRED EMBODIMENTS

Figure 1:
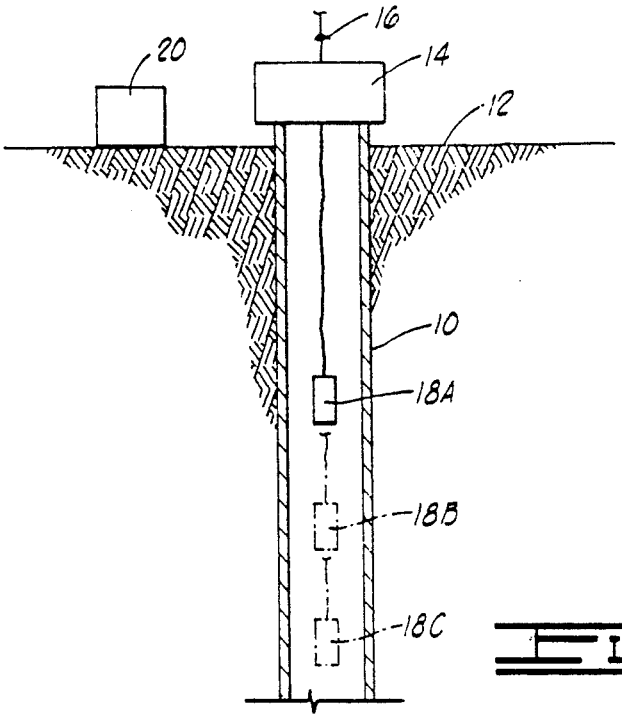
FIG. 1 is a schematic, sectioned, elevation view of a well having the tool of the present invention lowered in place therein, and illustrating the conducting of bubble-point tests at various elevations downhole within the well.

FIG. 1 schematically represents a well 10 penetrating the earth's surface 12. The upper end of the well 10 carries a conventional wellhead 14. A slick line or wireline 16 is shown extending downward through the wellhead 14 into the well 10 and carrying the measuring apparatus 18 on the lower end thereof. The position of apparatus 18 shown in solid lines is designated as 18A. In phantom lines, the apparatus is shown as having been lowered to two alternate positions designated as 18B and 18C.

At the earth's surface, a remote command station 20 is schematically represented. As further described below, the remote command station 20 may send command communication signals into the well to which the apparatus 18 will respond.

In FIGS. 2A-2D, the apparatus 18 is shown in elevation, sectioned, right-side only view. The apparatus 18 can generally be described as an apparatus for trapping a well fluid sample and for measuring a parameter of the well fluid sample while the apparatus 18 remains in place within the well 10.

The apparatus 18 includes a housing generally designated by the numeral 22. Housing 22 includes a valve housing section 24, a piston housing section 26, an intermediate housing section 28, a motor housing section 30, a controller housing section 32, a lower housing coupling 34, and a lower end cap 36, all of which are connected together by conventional threaded connections with O-ring seals being provided at appropriate places to provide a fluid-tight housing.

By removing the lower end cap 36 and turning the tool 18 upside down, the tool 18 can be attached to and run on an electric wireline for transmission of data to the surface for real time observation. The various references in the following description to up and down movement of the piston 52 are only for purposes of reference to the drawings as shown in FIGS. 2A-2D. It should be understood that the tool 18 is perfectly operable when inverted from the position shown in FIGS. 2A-2D.

Piston housing section 26 has a housing bore 38 defined therein which partially defines a sample chamber 40 (see FIG. 3A) therein.

Housing 22 further includes a sample collection passage 42 defined therein for communicating the sample chamber 40 with an exterior 44 of the housing 22.

The sample collection passage 42 includes a first radial port 46 through piston housing section 26, a second radial port 48 through valve housing section 24, and a bore 50 of valve housing section 24.

A piston generally designated by the numeral 52 is slidably received within the housing bore 38 with an annular piston seal 54 being provided therebetween. Piston 52 has extending downward therefrom a reduced diameter piston shaft 56 which is closely received through a lower reduced diameter bore 58 of piston housing section 26 with an 0-ring 60 being provided therebetween. A collar 62 is threadedly connected to the lower end of piston shaft 56 at thread 64.

Collar 62 has an internally threaded surface 66 which is threadedly engaged with a lead screw shaft 68. Lead screw shaft 68 includes a radially outward extending flange 70 which is received between upper and lower bearings 72 and 74 which are in turn sandwiched between a downward facing shoulder 76 of intermediate housing section 28 and an upward facing shoulder 78 of a bearing retainer 80. Bearing retainer 80 is threadedly connected to intermediate housing section 28 at thread 82.

An electric motor drive means 84 is received in the motor housing section 30. A rotatable motor shaft 86 extends upwardly therefrom. Motor shaft 86 is pinned by pin 88 to a coupling 90 which is connected to lead screw shaft 68 by splined connection 92.

The collar 62 includes a radially outward extending lug 94 which is received within a longitudinal slot 96 defined in the intermediate housing section 28.

Thus, as motor 84 rotates the lead screw shaft 68, the collar 62 is held against rotation by engagement of lug 94 with slot 96 and thus the collar 62 reciprocates upwardly and downwardly relative to the lead screw shaft 68. The collar 62 is fixedly attached to the piston shaft 56 and piston 52 and thus the piston 52 also reciprocates upwardly and downwardly within the housing 22 in response to rotation in one direction or the other of the motor shaft 86.

The lead screw shaft 68 and internal threads 66 of collar 62 may generally be described as a drive means operably connecting the electric motor 84 and the piston 52 for translating rotation of motor shaft 86 into movement of the piston 52 in the upward and downward directions relative to housing 22.

It will be appreciated that as the piston 52 moves downwardly within the housing bore 38, the volume of sample chamber 40 will increase or expand, and as the piston 52 moves upwardly within the housing bore 38, the volume of the sample chamber 40 will be contracted or reduced.

The piston housing section 26 includes a lower relief port 98 to allow fluid within bore 38 below piston 52 to escape as the piston 52 moves downward.

A valve means generally designated by the numeral 100 is provided for closing the sample collection passage 42 and trapping a well fluid sample in the sample chamber 40 after the piston has moved downward past a first position defined by the construction of the valve means 100.

The valve means 100 includes an annular flange portion 102 having a tapered downwardly facing seat 104 defined thereon. A hollow valve stem 106 extends downwardly below seat 104 and has a lower stem end 108.

The stem 106 includes a stem bore 110 which is open at the lower end 108. Upper and lower radial ports 112 and 114 communicate stem bore 110 with an annulus 116 defined between stem 106 and bore 50 of valve housing section 24.

A valve retainer 120 is threadedly connected to valve housing section 24 at thread 122. The lower portion of valve stem 106 is slidably received within a bore 124 of valve retainer 120.

A coil compression spring 126 is located within bore 50 above the valve 100 and is received about an upper spring centering stem 128.

Thus it will be appreciated that in the position of FIGS. 2A–2D wherein the piston 52 is in its uppermost position with an upper end 130 thereof abutting a lower end 132 of valve housing section 24, the spring 126 biases the valve 100 downward so that the lower end 108 of valve 100 abuts the upper end 130 of piston 52.

Figure 3A:
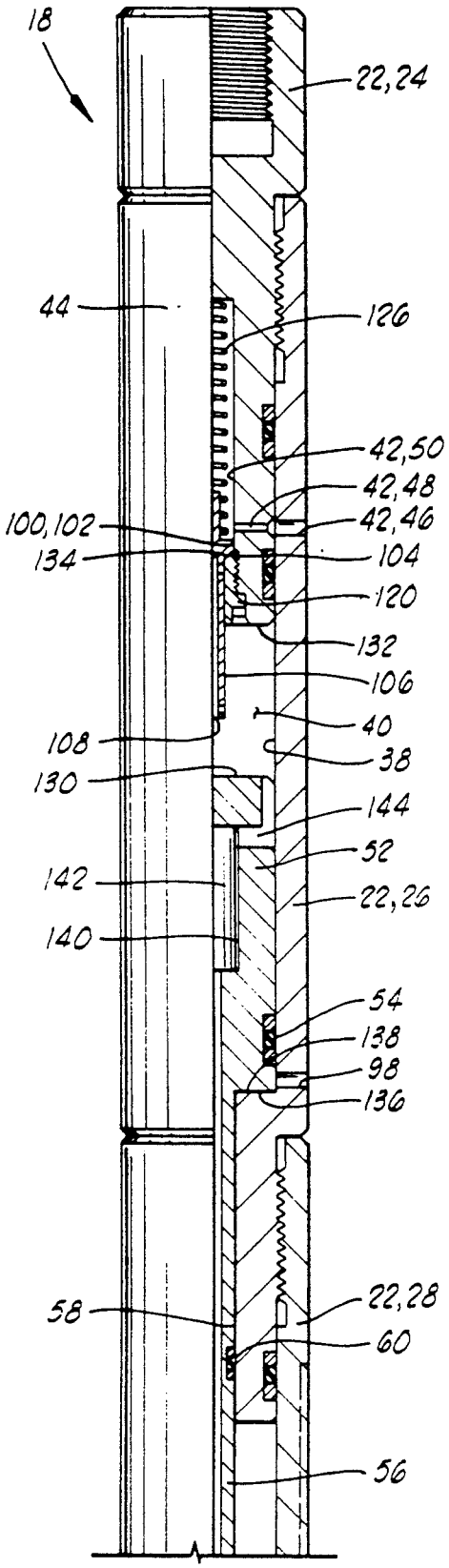
FIGS. 3A-3B show the upper portion of the tool of FIGS. 2A-2B with the piston of the tool moved to a downward position so that a fluid sample has been trapped within the sample chamber.

As the piston 52 moves downward to its lowermost position seen in FIG. 3A, the spring 126 biases the valve means 100 downward until the lower seat 104 engages an annular fixed seat 134 defined on the upper end of valve retainer 120, thus closing the sample collecting passage 42. It will be appreciated that so long as valve seat 104 is above fixed seat 134, well fluid from exterior of the housing 22 may flow through the sample collecting passage 42 to fill the sample chamber 40 as the volume of sample chamber 40 is expanded by downward movement of piston 52. After the valve seat 104 closes against fixed seat 134, the piston 52 can continue to move downward, but no further fluid will flow into the sample chamber 40. That is, a finite volume of fluid has been trapped within sample chamber 40, and further downward movement of piston 52 will expand the volume of the trapped fluid sample within the sample chamber 40. This expansion will continue until the sample chamber 40 reaches a maximum volume as illustrated in FIG. 3A when a downward facing shoulder 136 of piston 52 abuts an upward facing shoulder 138 of piston housing section 26.

Piston 52 has a cavity 140 defined therein within which is received a sensor means 142. A sensing passage 144 communicates fluid from the sample chamber 40 with the piston cavity 140 and thus with the sensor means 142 contained therein. The sensor means 142 may include any number of sensing devices for sensing various parameters of the trapped well fluid sample. Preferably the sensor means 142 includes both a pressure sensing element and a temperature sensing element.

It will be appreciated that as the piston 52 is later moved back upward from the position of FIG. 3A toward the position of FIG. 2A, it will at an intermediate position within its stroke, initially abut the lower end 108 of valve stem 106 and will thus push the valve means 100 back upward relative to housing 22. As the valve means 100 begins to move back upward, the seat 104 will immediately lift off of the fixed seat 134 thus reopening the sample collection passage 42 and allowing the previously trapped well fluid sample to be expelled or discharged from the sample chamber 40 through the sample collecting passage 42 back into the well 10 surrounding the housing 22.

A piston position sensor 146 is located within intermediate housing section 28. Position sensor 146 includes a spring biased rod 148 which is biased upwardly. An annular locator flange 150 is fixed to and extends radially outward from piston shaft 56 and abuts an upper end 152 of rod 148. As the piston 52 and piston shaft 56 move downwardly within housing 22, the flange 150 pushes the rod 148 downward into a sensor housing 154. Thus the position of rod 148 within sensor housing 154 is representative of the position of piston 52 within housing 22, and thus is representative of the volume of sample chamber 40. An electrical signal representative of the position of piston 52 and thus of the volume of sample chamber 40 is transmitted over electrical conductor 156 to a controller/recorder 158 seen in FIGS. 2C–2D. The controller/recorder 158 may also be referred to herein as the recorder/controller 158 or the controller 158 or the recorder 158 since it serves those multiple functions. The electrical conductor 156 may be considered to be part of an input line 157 which brings various inputs to the controller 158.

Signals generated by the pressure and temperature sensors within sensor means 142 are also transmitted over input line 156 to the controller 158.

Figure 2A:
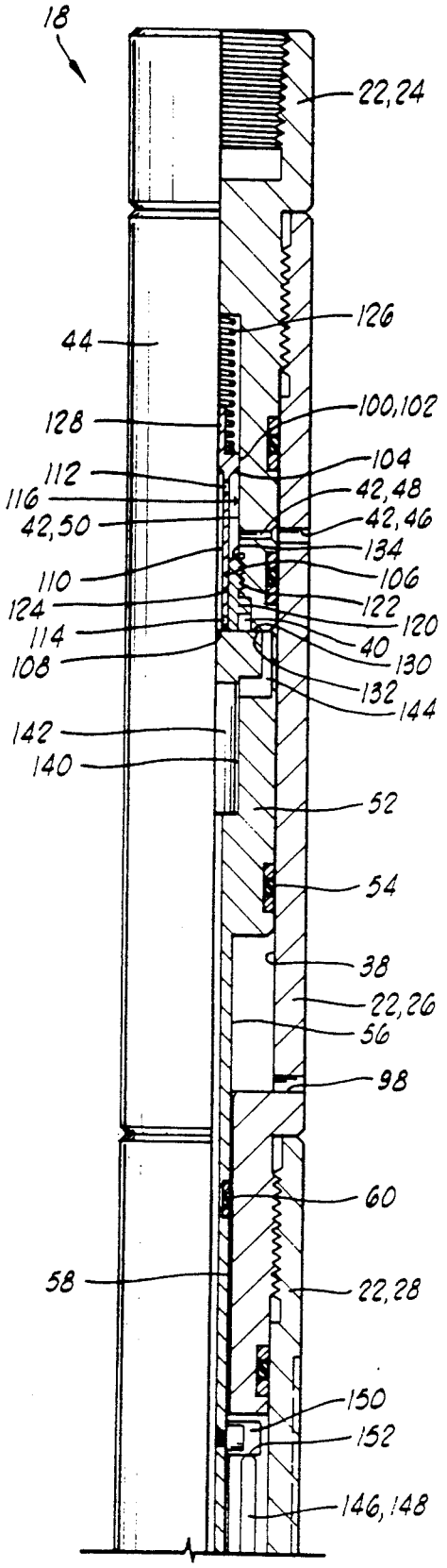
FIGS. 2A-2D comprise an elevation right-side only sectioned view of the apparatus of the present invention for trapping and measuring well fluid samples.
Figure 2B:
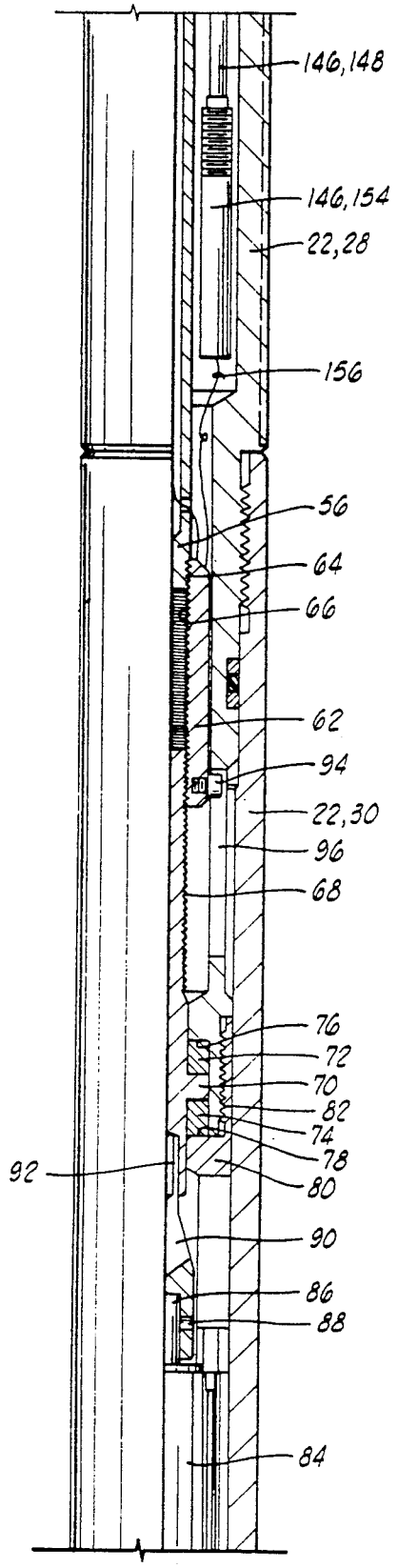
Figure 2C:
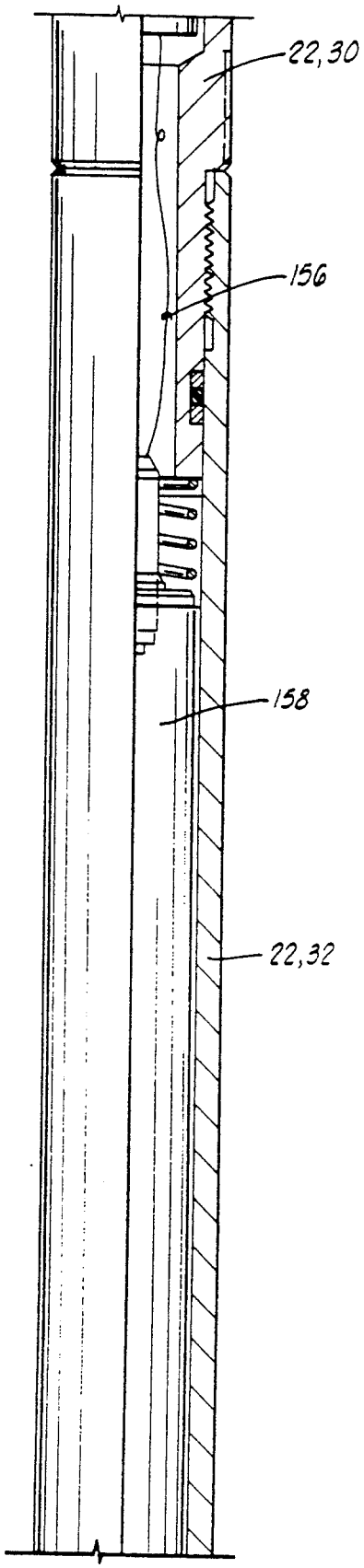
Figure 2D:
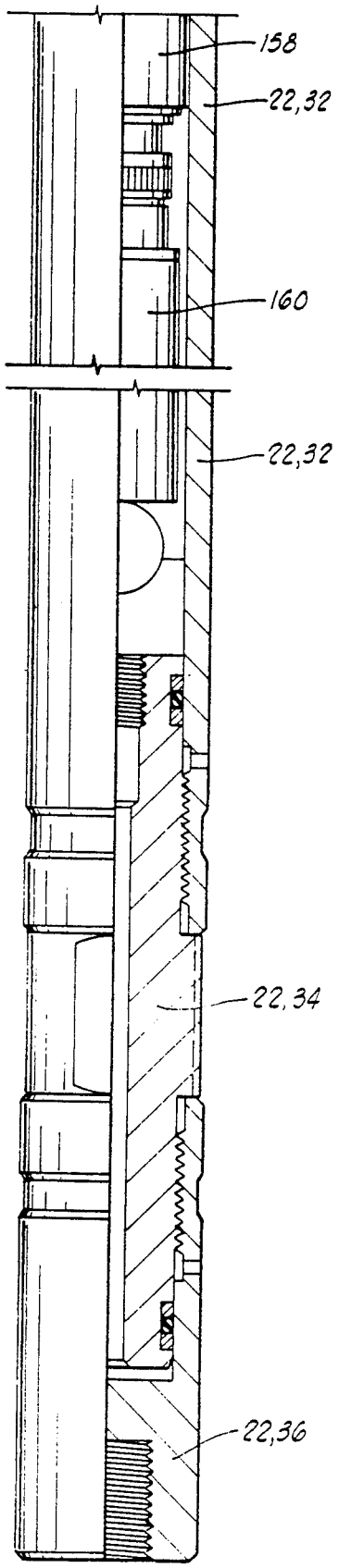

The external portions of controller 158 are seen in FIGS. 2C and 2D. Also located below controller 158 is a battery type power supply 160.

As is further described below, the controller 158 will control the operation of electric motor 84 and thus will control the movement of piston 52 in response to various factors including the inputs received from position sensor 146 and from the pressure and temperature sensors 142.

The controller/recorder 158 will record the pressure and temperature data measured by sensor means 142 and the volume data measured by piston position sensor 146. Taking this data into account, a plot can be made for the pressure versus volume data of a typical oil/gas sample as shown in FIG. 4.

Figure 4:
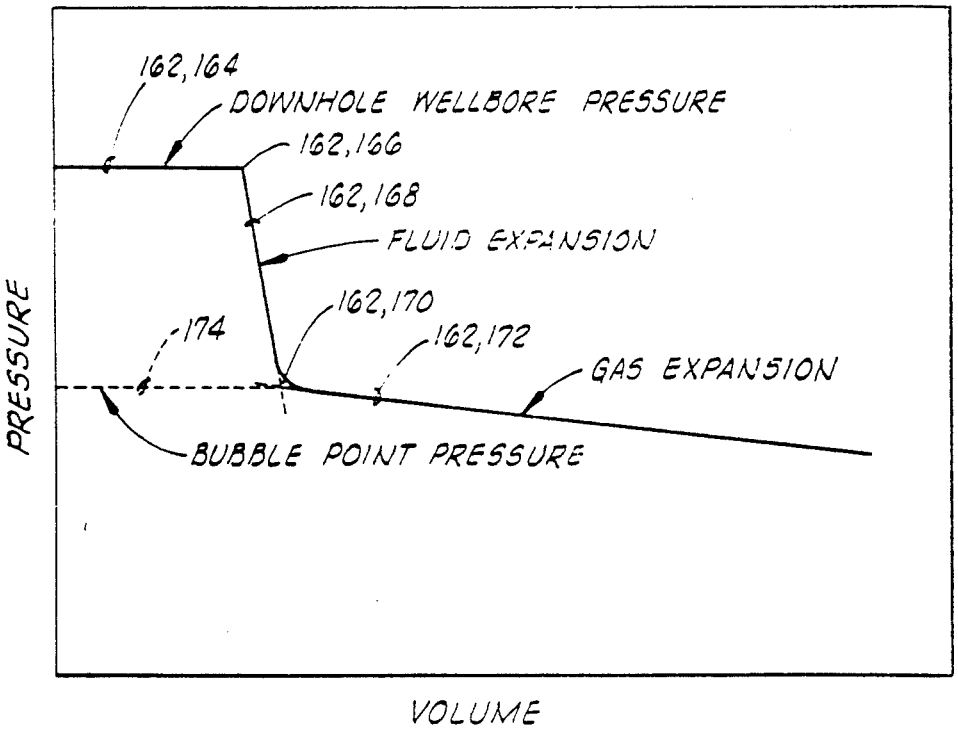
FIG. 4 is a graphical illustration of the pressure-versus-volume curve for a typical well fluid sample showing the change in pressure in the sample as the volume of the sample is increased with the tool of FIGS. 2 and 3.

In FIG. 4, volume increases along the horizontal axis and pressure increases along the vertical axis. A solid curve 162 represents the pressure versus volume relationship for a typical sample. Beginning at the left-hand end of the curve 162, a first substantially horizontal portion 164 of the curve represents the increasing volume of the sample as the sample is drawn into the sample chamber 40 before the valve means 100 closes. The valve means 100 closes at a volume represented by the break point 166 in the curve 162. A steeply dropping portion 168 of curve 162 represents expansion of the liquid oil sample before gas begins breaking out of solution. As is apparent from the steep drop of the curve 168, the pressure rapidly drops due to the low compressibility of the oil, until such time as gas begins coming out of solution. At a volume and pressure represented by break point 170 in curve 162, the gas begins coming out of solution and then a relatively more shallow downward sloping curve portion 172 represents the continuing drop in pressure with increasing volume as gas comes out of solution in the sample. The extrapolated dashed line 174 represents the bubble-point pressure of the sample, which is the pressure corresponding to break 170 in the curve 162. For a typical oil/gas sample, after the sample chamber 40 has been expanded to its maximum volume as shown in FIG. 3A, and as the piston 52 reverses and recompresses and then expels the sample, the pressure versus volume relationship with the sample will substantially track the same curve 162 in a reverse manner.

Figure 5:
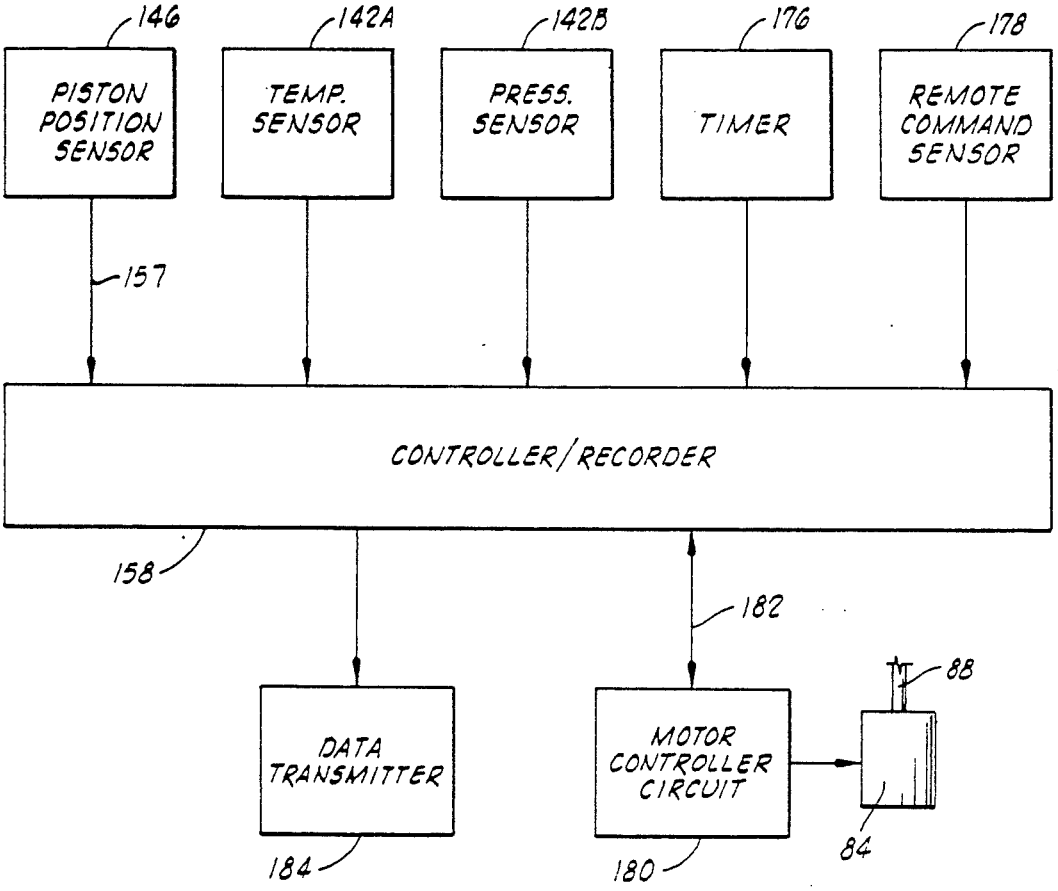
FIG. 5 is a block diagram showing a controller and connected input and output devices of the tool of FIGS. 2A-2D.

FIG. 5 is a block diagram of the controller/recorder 158 and the various input and output apparatus utilized therewith. The controller/recorder 158 may be a programmed microprocessor-based controller or it may be of any other suitable design (including non-microprocessor ones). FIG. 5 generally represents the arrangement of any type of controller/recorder and its associated inputs and outputs.

The controller/recorder 158 has data input from piston position sensor 146 which is representative of the volume of sample chamber 40.

Also data inputs from temperature sensor 142A and pressure sensor 142B are provided. The temperature and pressure sensors 142A and 142B may both be located within the sensor means 142 illustrated in FIG. 2A.

In a preferred version of the apparatus 18, the controller/recorder 158 is constructed to periodically cycle through the process of sampling and testing of the well fluid surrounding the apparatus 18. For example, the controller/recorder 158 may be constructed so that it runs through a sampling and testing cycle and then is dormant for a scheduled interval of time, e.g., ten minutes, and then the testing cycle is repeated. With such an arrangement, the pressure, volume and temperature data can be recorded as a function of time and then all that is necessary to correlate that data to the proper position in the well is to also record the position of the apparatus 18 in the well as a function of time which is easily accomplished through known means.

In FIG. 5, a timer is schematically illustrated and designated by the numeral 176 for providing the appropriate timing signals to controller/recorder 158 so that samples will be drawn and tested at appropriate intervals. It will be understood that the timer 176 may also be incorporated in the controller/recorder 158 or may be accomplished by appropriate programming of a controller/recorder 158 which has built-in timing devices.

An alternative mode of operation of the controller/recorder 158, instead of the use of a repeating timer like the timer 176 just described, is to provide the controller/recorder 158 with appropriate means for interfacing with a remote command sensor 178. With such a system, command signals may be sent from the remote command signal center 20 located at the surface 12 and those signals can be received by remote command sensor 178 which is located downhole within the apparatus 18, thus allowing for the drawing and testing of a well fluid sample in response to such remote commands. A number of alternative systems for providing remote control of the controller/recorder 158 are further described below.

The controller/recorder 158 will control the motor 84 through a motor controller circuit 180. Output control signals from recorder/controller 158 are conveyed to motor controller circuit 180 over control lines 182.

In the preferred embodiment of the invention utilizing the timer 176, the pressure volume and temperature data will simply be recorded within controller/recorder 158 and will not necessarily be communicated back to the surface in real time. It is possible, however, through a number of means to provide real time communication of the pressure volume and temperature data to the surface. If this is desired, the controller/recorder 158 will output the data to data transmitter 184. The data transmitter 184 may be of various designs, and may use the same remote communication systems which are available for sending and receiving remote command signals through the remote command sensor 178. Again, these systems are further described below.

Figure 6:
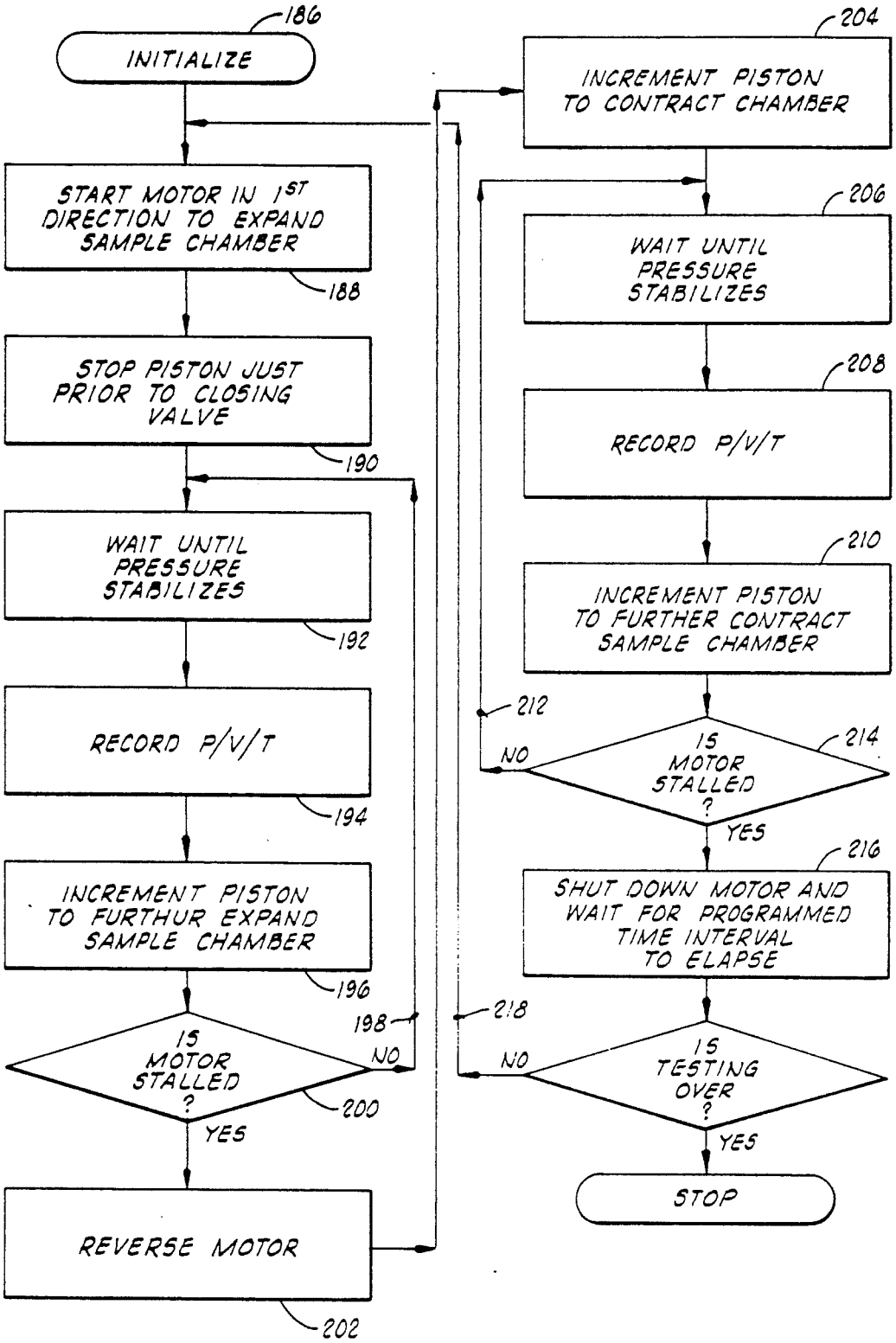
FIG. 6 is a logic flow diagram illustrating the operations performed by the controller of FIG. 5.

Physical steps performed in operating the motor control circuit 180 will generally follow the operational flow chart set forth in FIG. 6.

The operation of the tool begins when the controller/recorder 158 is connected to power supply 160 and the controller/recorder 158 will initialize as indicated at 186.

The controller/recorder 158 will then provide electrical power to motor control circuit 180 and thus to motor 84 to begin turning the motor shaft 86 in a first direction which will cause the piston 52 to start moving downward within housing 22 from its upwardmost position of FIG. 2A to expand the volume of sample chamber 40 as indicated in the flow chart at 188.

The piston 52 will be moved steadily downward, and the spring-biased valve means 100 will follow the piston 52 until the seat 104 of valve means 100 is just short of closing against seat 134 of housing 22. The controller/recorder 158 will be tracking the position of piston 52 and thus of valve means 100 by the input from the linear position sensor 146. Just prior to closing of the valve means 100, the controller/recorder 158 will stop the motor 84 and thus stop the piston 52 as indicated at block 190.

The pressure of the sample within the sample chamber 40 is constantly being monitored by pressure sensor 142 which inputs a pressure signal to the controller/recorder 158. The controller/recorder 158 will hold the piston 52 motionless until it determines that the pressure of the sample within sample chamber 40 has stabilized as indicated at block 192.

Once the pressure within sample chamber 40 is stabilized, the controller/recorder 158 will cause pressure volume and temperature measurements of the sample to be made and recorded as indicated at 194.

Then the controller/recorder 158 will begin incremental rotation of motor 84 and thus movement of piston 52 in small increments to further expand the sample chamber 40. This is indicated at block 196.

After each increment, the controller/recorder will return to operational step 192 as indicated by logic line 198 unless the motor 84 has stalled out indicating that the piston 52 has abutted the shoulder 138 as shown in FIG. 3A. Until such time as the piston 52 has bottomed out as shown in FIG. 3A, the controller/recorder 158 will continue to repeat the cycle of incrementally expanding the sample chamber 40, then allowing pressure within the sample chamber 40 to stabilize, then recording pressure, volume and temperature for the sample.

It will be appreciated that after one, or perhaps a few, incremental steps have occurred, the valve means 100 will close thus trapping the sample within the sample chamber 40. Further incremental expansions of the sample chamber will begin to expand the fluid sample trapped in the sample chamber 40 as represented at portions 168 and 172 of the pressure versus volume curve 162 shown in FIG. 4.

When the valve means 100 closes, the sample chamber 40 is isolated from fluid communication with the surrounding well fluid and thus a well fluid sample of finite volume is trapped within the sample chamber 40.

The slow incremental closing of the valve 100 insures that the sample trapped within chamber 40 is representative of the fluid surrounding the apparatus 18 and it eliminates any dynamic effects of a sample rapidly rushing into a chamber 40. By stopping the piston 52 prior to closing of valve means 100, the sample chamber 40 is allowed to completely fill with this representative sample and then the sample collecting passage 42 is slowly closed.

This incremental movement of piston 52 will continue until the piston 52 bottoms out against shoulder 138 as shown in FIG. 3A. When that occurs it will be sensed by the motor control circuit 180 which will provide an appropriate feedback signal to controller/-recorder 158 as represented by operational box 200.

Upon determining that the piston 52 has bottomed out, the controller/recorder 158 will reverse the direction of electrical power to motor 84 and thus reverse the direction of rotation of motor 84 as indicated at operational block 202.

The controller/recorder 158 will then cause the motor 84 to incrementally rotate in this opposite direction to begin moving the piston 52 back upward to incrementally contract the volume of sample chamber 40 as indicated at operational block 204.

After the first increment, the controller/recorder 158 will determine when pressure within the sample chamber 40 has stabilized as indicated at block 206. Then, pressure, volume and temperature will be measured and recorded as indicated at block 208. Then, the piston 52 will be again incremented to further contract the sample chamber 40 as indicated at 210.

So long as the piston 52 has not again stalled out in its uppermost position as shown in FIG. 2A, the recorder/-controller 158 will repeat the cycle of allowing pressure to stabilize, then recording pressure, volume and temperature, then further incrementing the piston, as indicated by logic line 212.

When the piston 52 does reach its uppermost position abutting lower end 132 of valve housing section 24, the motor 84 will again stall out which will be sensed by motor controller circuit 180, and the controller/-recorder 158 will direct the motor 84 to shut down and will then wait for a programmed time interval to elapse as determined by timer 176. These steps are represented by operational blocks 214 and 216.

So long as the controller/recorder has not been turned off or otherwise received a command indicating that testing should be terminated, the process will return to the beginning as indicated by logic line 218 after the appropriate elapsed time and the motor 84 will again be started in a first direction to expand sample chamber 40 as indicated by operational block 188.

Thus, the apparatus 18 may be lowered into the well 10 as generally indicated in FIG. 1 and moved between a variety of positions such as 18A, 18B and 18C while allowing the controller/recorder 158 to go through the cycle of drawing and testing a sample as represented in FIG. 6 one or more times for each of the positions 18A, 18B and 18C.

Each of these samples is taken while the tool 18 remains downhole in the well. Each test will begin with the well fluid sample trapped in the sample chamber 40 at a pressure and temperature substantially identical to that of well fluid in the well 10 at the downhole location at which the sample was trapped, and without the trapped fluid sample having gone through any significant change in pressure or temperature during the trapping procedure and prior to the actual expansion of the sample as indicated at portion 168 of the curve 162 shown in FIG. 4.

From the pressure versus volume data which is generated and recorded by recorder/controller 158, the bubble-point pressure of the trapped sample can be determined as represented by the horizontal value 174 shown in the pressure versus volume chart of FIG. 4. It will be appreciated that the actual analysis of the data may not be conducted until the recorder/controller 158 has been retrieved to the surface. It is also very possible, however, for the recorder/controller 158 to interpret the data downhole and communicate upward by data transmitter 184 data indicative of the bubble-point pressure 174. Also, it is possible for the recorder/controller 158 to communicate the raw data uphole and for that data to be analyzed in real time at the surface.

In addition to determining the bubble-point pressure of the sample, other parameters of the trapped sample such as the compressibility of the sample may be readily determined from the pressure versus volume data like that of FIG. 4.

By trapping one or more well fluid samples and measuring the bubble point thereof at a plurality of elevations within the well as indicated by positions 18A, 18B and 18C in FIG. 1, it can then be readily determined at what depth within the well 10 the gas in solution in the produced well fluid is breaking out of solution. It will be appreciated by those skilled in the art that it is of considerable interest to know at what point within the well the natural dissolved gas breaks out of solution from the liquid oil. For example, it is very undesirable for the gas to break out of solution at the formation face where the well fluid first flows into the well, and thus if it can be determined by tests like those illustrated in FIG. 1 that the gas is not breaking out of solution until the fluid has reached some given elevation within the well, this will confirm that the well is operating in a satisfactory manner and that gas is not breaking out of solution as the fluid is initially produced into the well bore.

During the testing described above, the well can either be flowing or not flowing.

ALTERNATIVE MODES OF TRANSPORTING THE TOOL INTO THE WELL

Figure 3B:
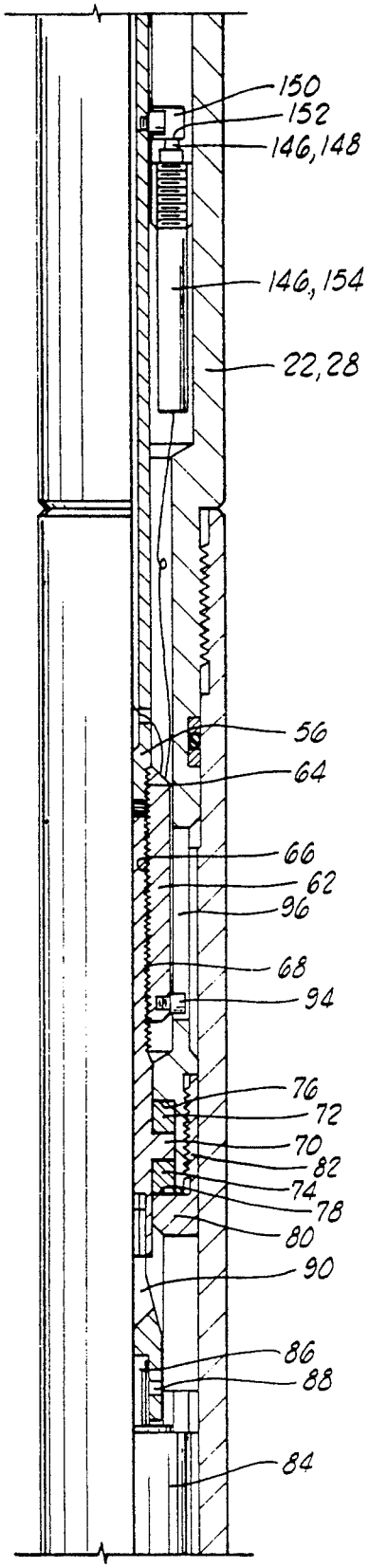

The description set forth above of the tool 18 in connection with FIGS. 1-3 shows one preferred manner of transporting the apparatus 18 into the well, namely on a slick line or wireline 16.

In addition to being run on a slick line or wireline, the tool 18 may also be placed inside a gauge carrier and included in a workstring like other types of gauges commonly utilized in drill stem testing wherein various test tools including the gauges are run on a string of tubing generally referred to as a test string. The apparatus 18 may easily be constructed to be received in a one-inch to one-and-one-half-inch diameter cavity of a gauge carrier.

When the apparatus 18 is run in a gauge carrier as part of a drill stem test string, the apparatus 18 is typically left in place in the gauge carrier in the drill stem test string during the entire period of the drill stem test which typically will last from five days to two weeks. The data collected during this long interval of time will show how the properties of the well fluid being produced during the drill stem testing changes as the testing proceeds. If the pressure-versus-volume data stabilizes over the five-day to two-week interval of the drill stem test, the operator will know that the well flow observed during the drill stem test is stabilized and is truly representative of what can be expected on a long-term basis from the well. If the data procured by apparatus 18 shows that the pressure-versus-volume data for successive oil samples never stabilized during the five-day to two-week interval of the drill stem test, then it will be apparent that the drill stem test results may not be entirely representative of what can be ultimately expected from the well.

When running the apparatus 10 as part of a drill stem test string, there are other possible locations for the apparatus 18 rather than being placed within a gauge carrier as just described. For example, the apparatus 18 may be constructed as a part of the drill stem test string and located below the packer of the test string and near the sand face of the formation being tested.

Yet another alternative location within the drill stem test string for the apparatus 18 is to place it above the packer and below a formation tester valve of the drill stem test string.

When used as part of a drill stem test string, the apparatus 18 is of course useful in both cased hole drill stem testing and in open hole drill stem testing.

It should also be noted that traditional samplers may be run with the apparatus 18 for trapping a sample to be returned to the surface. This is possible regardless of whether the apparatus 18 is run on wireline or slick line or whether it is run as part of a drill stem test string. For example, when running the apparatus 18 on a wireline or slick line 16, a traditional bottom hole sampler may be located immediately below the apparatus 18 to trap a sample for return to the surface. Once the entire assembly is brought back to the surface, the data from apparatus 18 can be used to immediately identify the bubble point pressure of the sample which has been trapped in the conventional sampler. The sampler trapped in the conventional sampler can then be immediately taken to the laboratory without in any way manipulating or affecting the trapped sample. This is contrasted to prior art techniques wherein trapped samples which are returned to the surface are typically manipulated as soon as they have been retrieved to try to obtain a preliminary indication of the bubble point pressure of the sample.

Finally, it should be noted that the apparatus 18 is equally as useful in the testing of producing wells as it is in the drill stem testing of newly drilled wells. Further, wells can be tested while flowing or while shut in.

THE RECORDER/CONTROLLER OF FIGS. 7A-7C

Figure 7A:
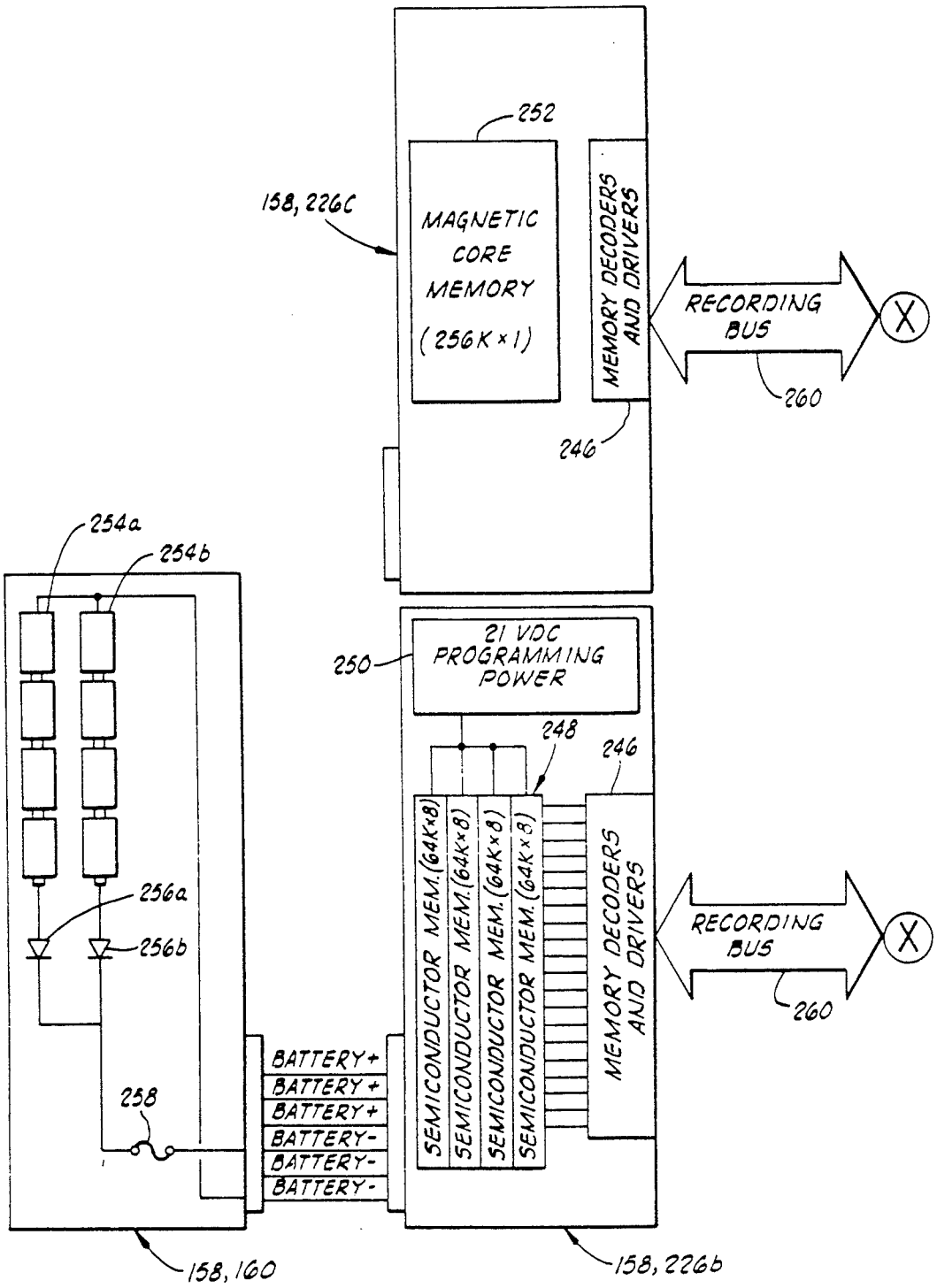
FIGS. 7A-7C comprise a block diagram of an implementation of the system shown in FIG. 5.
Figure 7B:
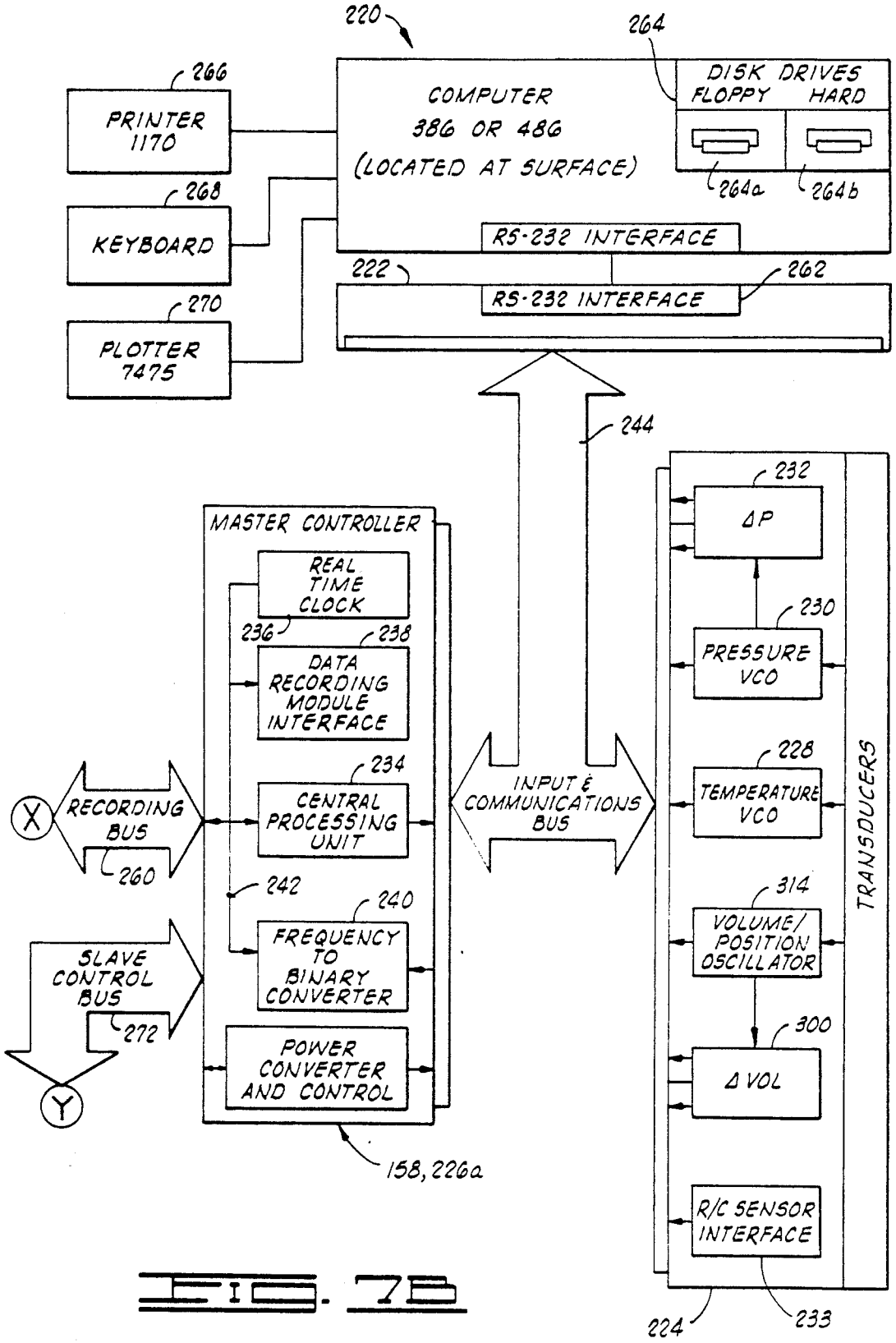
Figure 7C:
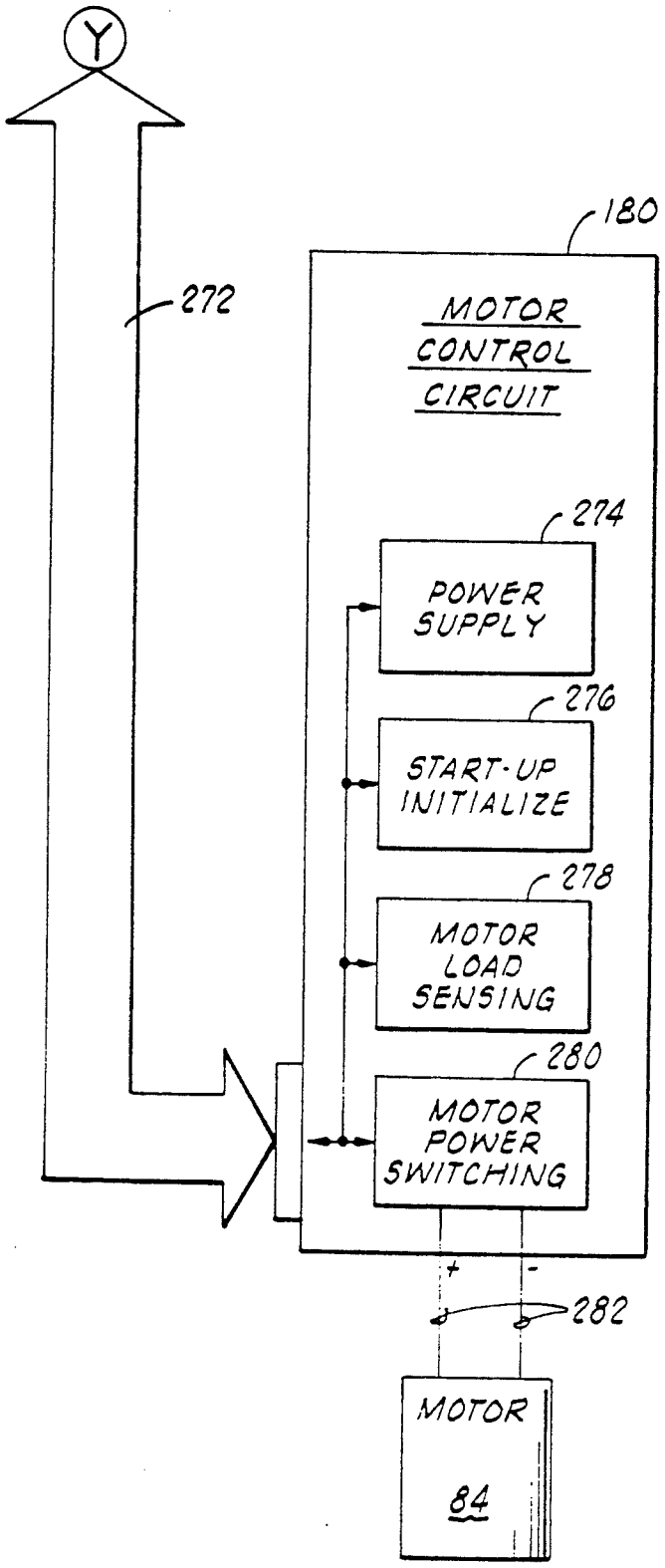

FIGS. 7A-7C comprise a block diagram of an implementation of the recorder/controller 158, a surface computer system 220, an interface 222 between recorder/controller 158 and surface computer system 220, and the motor control circuit 180. The recorder/controller 158 may also be referred to as a recorder/master controller 158 and the motor control circuit 180 can be generally referred to as a slave controller 180 which operates in response to the recorder/master controller 158.

One skilled in the art may write a program to carry out the series of operations previously described with regard to FIG. 6 and this program would be placed in the recorder/master controller 158.

Particularly, FIGS. 7A and 7B show in block diagram format the arrangement of the recorder/master controller 158 and associated surface computer system 220 and interface 222. A similar system is described in detail in U.S. Pat. No. 4,866,607 to Anderson et al., entitled SELF-CONTAINED DOWNHOLE GAUGE SYSTEM, and assigned to the assignee of the present invention, all of which is incorporated herein by reference. The Anderson et al. patent describes a self-contained downhole gauge system which continuously monitors downhole pressure and temperature and records appropriate data. The interface with surface computer system 220 allows programming of the recorder/-master controller 158 prior to running the tool in the well, and permits subsequent retrieval of data after retrieval of the tool from the well. The Anderson et al. system is described primarily in the context of a system for monitoring and recording pressure and temperature readings, but it is also disclosed at column 33, line 61 through column 34, line 8 as being suitable for the control of other instruments such as the apparatus for sampling fluids and the like which are involved in the present application.

FIGS. 7A and 7B show, in block diagram format, elements comprising the preferred embodiment of the recorder/master controller 158, the interface 222 and the surface computer system 220. The preferred embodiment of the recorder/master controller 158 is made of three detachable segments or sections which are electrically and mechanically interconnectable through multiple conductor male and female connectors which are mated as the sections are connected. These three sections are contained within respective linearly interconnectable tubular metallic housings of suitable types as known in the art for use in downhole environments. As shown in FIGS. 7A and 7B, the three sections of the recorder/master controller 158 include (1) a transducer section 224, (2) a master controller/power converter and control/memory section 226 comprising master controller and power converter and control portion **226*a* and a data recording module including an interchangeable semiconductor memory portion 226*b* or magnetic core memory portion 226*c*, and (3) the battery section 160**.

Various types of a plurality of specific embodiments of the transducer section 224 can be used for interfacing the recorder/master controller 158 with any suitable type of transducers 142, regardless of type of output. Examples of suitable transducers 142 include a CEC pressure-sensing strain gauge with a platinum RTD, a Hewlett-Packard 2813B quartz pressure probe with temperature sub, a Geophysical Research Corporation EPG-520H pressure and temperature transducer, and a Well Test Instruments 15K-001 quartz pressure and temperature transducer. However, regardless of the specific construction used to accommodate the particular output of any specific type of transducer 142 which may be used, the preferred embodiment of the transducer section 224 includes a temperature voltage controlled oscillator circuit 228 which receives the output from the particular type of temperature transducer 142A used and converts it into a suitable predetermined format (such as an electrical signal having a frequency proportional to the magnitude of the detected condition) for use by the controller portion in the section 226 of the recorder/master controller 158. The preferred embodiment of the transducer section 224 also includes a pressure voltage controlled oscillator circuit 230 for similarly interfacing the specific type of pressure transducer 142B with the controller portion of the section 226. Associated with the pressure voltage controlled oscillator 15 circuit 230 in the preferred embodiment is a delta pressure (ΔP) circuit 232 which provides hardware monitoring of rapid pressure changes and which generates a control signal in response to positive or negative pressure changes which pass a predetermined threshold; this can be used for interfacing a sensed pressure signal as the remote command sensor 178 (FIG. 5), or a separate remote command interface 233 as may be needed (such as to implement alternatives described hereinbelow) can be used. These three circuits 228, 230 and 232, along with a voltage reference circuit are described in detail in Anderson et al. U.S. Pat. No. 4,866,607 with reference to FIGS. 3–9 thereof, all of which is incorporated herein by reference.

The delta pressure circuit 232 can also be implemented for use with the motor control circuit 180 as further described hereinbelow with reference to FIGS. 8 and 9. In conjunction with this, the transducer section 224 further includes a volume or position oscillator circuit 314 that connects to the piston position sensor 146 represented in FIG. 5. A delta volume (Δ Vol) circuit 300 of the transducer section 224 is responsive to the circuit 314 for use by the motor control circuit 180 as described hereinbelow with reference to FIGS. 8 and 9.

The controller portion of the controller/power converter and control/memory section 226 includes a central processing unit circuit 234, a real time clock circuit 236 (which may provide the timer means 176), a data recording module interface circuit 238 and a frequency-to-binary converter circuit 240, which elements generally define a microcomputer means for receiving electrical signals in the predetermined format from the transducer section 224, for deriving from the electrical signals digital signals correlated to a quantification of the magnitude of the detected parameter, for storing the digital signals in the memory portion of the section 226, and for sending command signals to the motor control circuit 180. These four circuits communicate with each other over a suitable bus and suitable control lines generally indicated in FIG. 7B by the reference numeral 242. The central processing unit circuit 234 also communicates with the surface computer system 220 through the interface 222 over input and communications bus 244. The central processing unit 234 also communicates, through a part of the circuitry contained on the circuit card on which the data recording module interface circuit 238 is mounted, with the transducer section 224 over bus 244 to receive an interrupt signal generated in response to the ΔP signal from the ΔP circuit 232. The frequency-to-binary converter circuit 240 also communicates with the transducer section 224 over bus 244 by receiving the temperature and pressure signals from the circuits 228, 230, respectively. The circuit 240 converts these signals into digital signals representing numbers corresponding to the detected magnitudes of the respective conditions in sample chamber 40. The real time clock circuit 236 provides clocking to variably control the operative periods of the central processing unit 234. The data recording module interface circuit 238 provides, under control by the central processing unit 234, control signals to the memory portion of the section 226. Each of the circuits 234, 236, 238 and 240 are more particularly described in Anderson et al. U.S. Pat. No. 4,866,607 with reference to FIGS. 10, 11, 12 and 13 thereof, respectively, all of which is incorporated herein by reference.

The power converter and control portion of the section 226 includes circuits for providing electrical energy at variously needed DC voltage levels for activating the various electrical components within the recorder/master controller 158. Although not necessary to the preferred embodiment of the present invention, this portion can also include an interconnect circuit for controlling the application of at least one voltage to respective portions of the recorder/master controller 158 so that these portions of the recorder/master controller 158 can be selectively powered down to conserve energy of the batteries in the battery section 160. The specific portions of the preferred embodiment of the power converter and control portion are described in Anderson et al. U.S. Pat. No. 4,866,607 with reference to FIGS. 14–17 thereof, all of which is incorporated herein by reference.

The data recording module or memory portion of the section 226 includes either the semiconductor memory portion **226*b* or the magnetic core portion 226*c* or a combination of the two. Each of these portions includes an addressing/interface, or memory decoders and drivers, section 246. The semiconductor memory portion 226*b* further includes four 64K × 8 (K=1024) arrays of integrated circuit, solid state semiconductor memory. These are generally indicated by the reference numeral 248 in FIG. 7A. A 21-VDC power supply 250 is contained within the portion 226*b* for providing a programming voltage for use in writing information into the memory 248. The magnetic core memory portion 226*c* includes a 256K × 1 array of magnetic core memory generally identified in FIG. 7A by the reference numeral 252. These elements of the memory portion are described in Anderson et al. U.S. Pat. No. 4,866,607 with reference to FIGS. 18–23** thereof, the details of which are incorporated herein by reference.

The battery section 160 shown in FIG. 7A includes, in the preferred embodiment, a plurality of lithium-thionyl chloride or lithium-copper oxyphosphate, C-size cells. These cells are arranged in six parallel stacks of four series-wired cells. Two of these stacks are shown in FIG. 7A and identified by the reference numerals **254*a*, 254*b*. Each series is protected by a diode, such as diodes 256*a*, 256*b* shown in FIG. 7A, and each parallel stack is electrically connected to the power converter and control portion through a fuse, such as fuse 258 shown in FIG. 7A. In the preferred embodiment the parallel stacks are encapsulated with a high temperature epoxy inside a fiber glass tube. These battery packs are removable and disposable, and the packs have wires provided for voltage and ground at one end of the battery section. The batteries are installed in the recorder/master controller 158 at the time of initialization of the recorder/-master controller 158**.

The memory sections 226*b* and 226*c* communicate with master controller 226*a* over recording bus 260.

The interface 222 through which the recorder/master controller 158 communicates with the surface computer system 220 comprises suitable circuitry as would be readily known to those skilled in the art for converting the signals from master controller 226*a* into the appropriate format recognizable by the surface computer system 220. In the preferred embodiment this conversion is from the input signals from bus 244 at the inputs of the interface 222 to suitable RS-232 standard interface format output signals at the output of the interface 222. The RS-232 output is designated by the block marked with the reference numeral 262. Broadly, the interface 222 includes two serial data ports, transmit and receive, and four hand shake lines.

The surface computer system 220 of the preferred embodiment with which the interface 222 communicates is an IBM compatible Model 386 or Model 486 personal computer with floppy and hard disk drives 264*a* and 264*b*, respectively. The personal computer is labeled in FIG. 7B with the reference numeral 220. Suitably associated with the personal computer 220 in a manner as known to the art are a printer 266, a keyboard 268 and a plotter 270. The computer 220 can be programmed to perform several functions related to the use of the recorder/master controller 158. An operator interface program enables an operator to control the operation of the computer through simple commands entered through the keyboard 268. A test mode program is used to test the communication link between the computer 220 and the interface 222. A tool test mode program provides means by which the operator can test the recorder/master controller 158 to verify proper operation. A received data mode program controls the interface 222 to read out the contents of the memory of the recorder/master controller 158; after the memory has been read into the interface 222, the information is transmitted to the computer 220 with several different verification schemes used to insure that proper transmission has occurred. A write data mode program within the computer 220 automatically writes the data received from the interface 222 to one or both of the disks as an ASCII file so that it may be accessed by Database programs or by Reservoir Engineering software packages. A set-up job program allows the operator to obtain various selectable job parameters and pass them to the interface 222. A monitor job program allows the operator to monitor any job in progress.

Under control of the aforementioned programs in the surface computer 220, several programs can be run on a microprocessor within the interface 222. A core memory test program in the recorder/master controller 158 reads and writes, under control from the interface 222, a memory checkerboard pattern to read and verify proper operation of the magnetic core memory in the recorder/master controller 158 when it is connected to the interface 222 and to maintain a list of any bad memory locations detected. A processor check program checks the status of a microprocessor within the recorder/master controller 158. A tool mode select program places the recorder/master controller 158 in the proper mode for the test being run, and a set-up job program further configures the recorder/master controller for the job to be run. A core memory transfer program reads the contents of the memory of the recorder/master controller 158 and stores that information in memory within the interface 222 prior to transfer to the surface computer 220.

Through the use of the foregoing programs, the tool operator initializes the recorder/master controller 158 prior to lowering the recorder/master controller 158 into the well 10. In the preferred embodiment the operator initializes the recorder/master controller 158 using a pre-defined question and answer protocol. The operating parameters, such as test delay times, sampling intervals, serial numbers of the individual instruments, estimated testing time and a self-test or confidence test, are established at initialization and input through the question and answer protocol. Other operating parameters include the desired time interval between the drawing of successive samples into sample chamber 40, and the degree of stabilization of pressure prior to each incremental piston movement. Also, if a remote command alternative is to be available via remote command sensor 178, the operator will enter identifying information for the appropriate command signal to interrupt the periodically timed sampling and to instead sample upon command.

After the downhole test has been run and the recorder/master controller 158 removed from the well 10, the tool operator connects the memory portion 226*b* or 226*c* with the interface 222 to read out the volume, temperature, pressure and time data stored within the memory section 226*b* or 226*c*. Through another question and answer protocol and other suitable tests, the operator insures that the recorder/master controller 158 is capable of outputting the data without faults. When the data is read out, it is passed through the interface 222 to the surface computer system 220 for storage on the hard disk drive 264*b* for analysis.

The master controller 226*a* communicates with the motor control circuit 180 over slave control bus 272. Circuitry of motor control circuit 180 illustrated in FIG. 7C includes a power supply 274, start-up initialize means 276, motor load sensing means 278, and motor power switching means 280.

The motor power switching means 280 controls flow of electrical power over electrical conduits 282 to the electric motor 84 which moves the piston 52 to expand or contract sample chamber 40.

The piston 52 will move downward until it abuts shoulder 138 of the housing 22 or until the pressure differential across the piston seal becomes large enough. The motor 84 will stop when the resistance encountered in moving the piston 52 and associated components becomes great enough to cause the current going to the motor 84 to reach a predetermined level, i.e., a stall level as sensed by the motor load sensing means 278, at which the motor control circuit 180 will remove the driving power from the motor 84.

The motor power may be also made dependent upon the position of the subassembly as indicated by the linear position sensor 146. Thus the tool can be designed to stop the piston 52 short of actually shouldering the piston against the housing 22 and actually stalling the motor 84.

THE IMPLEMENTATION OF FIGS. 8-10

Figure 8:
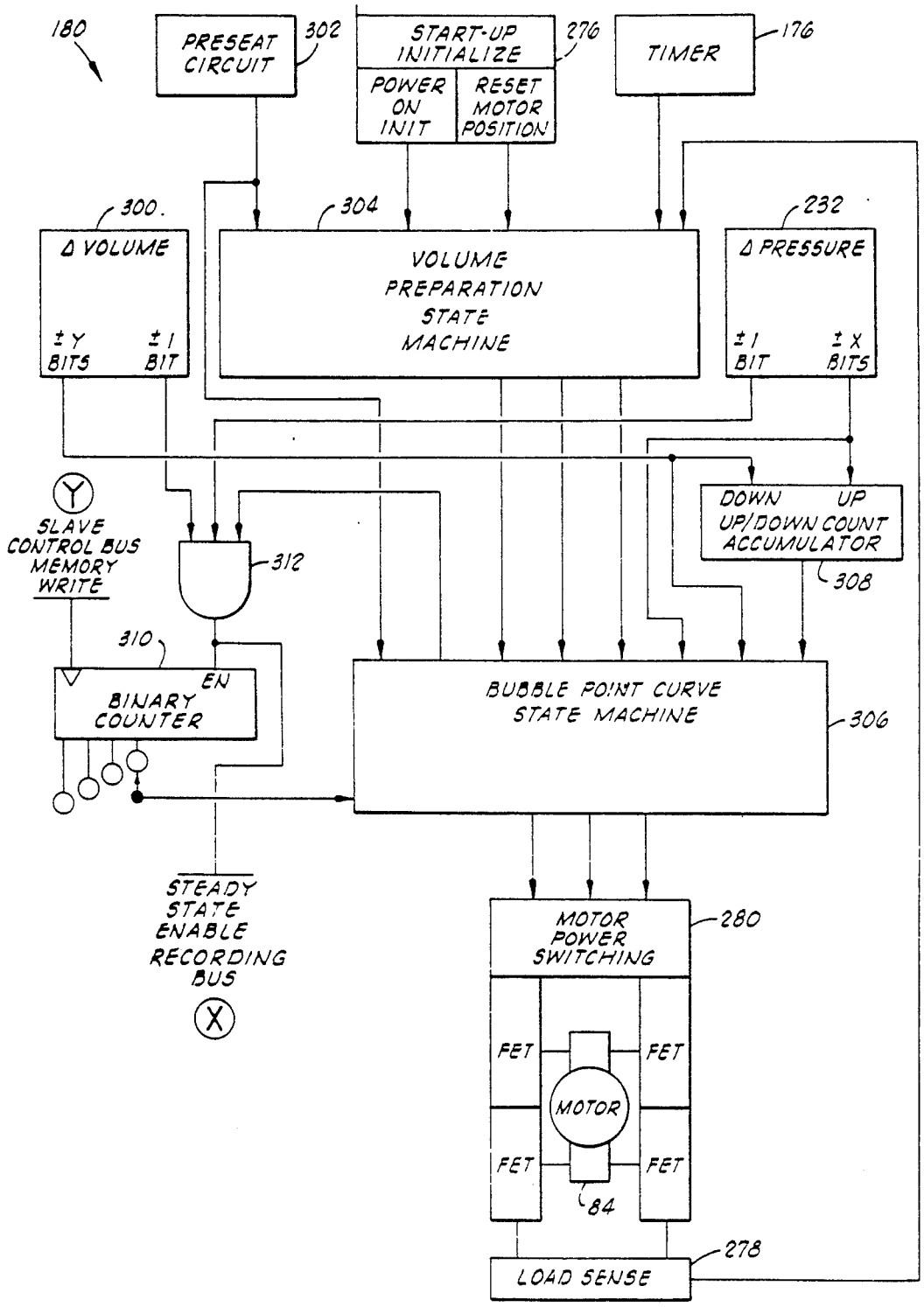
FIG. 8 is a block diagram of a motor control circuit.
Figure 9:
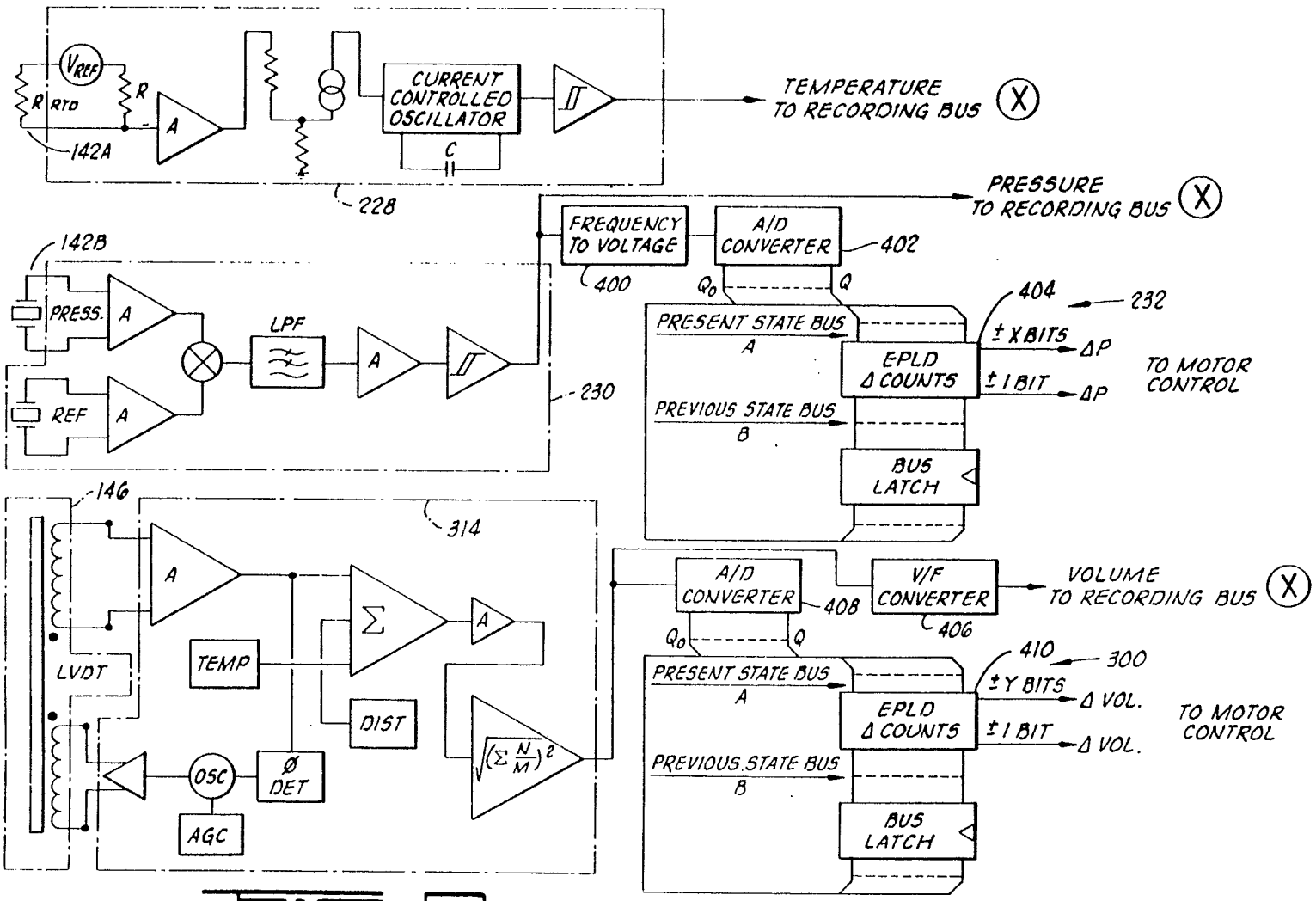
FIG. 9 is a schematic and block diagram of implementations of a temperature sensing circuit, a pressure sensing circuit, a volume or position sensing circuit, a delta pressure circuit and a delta volume circuit, the last two of which provide control signals to the motor control circuit of FIG. 8.
Figure 10:
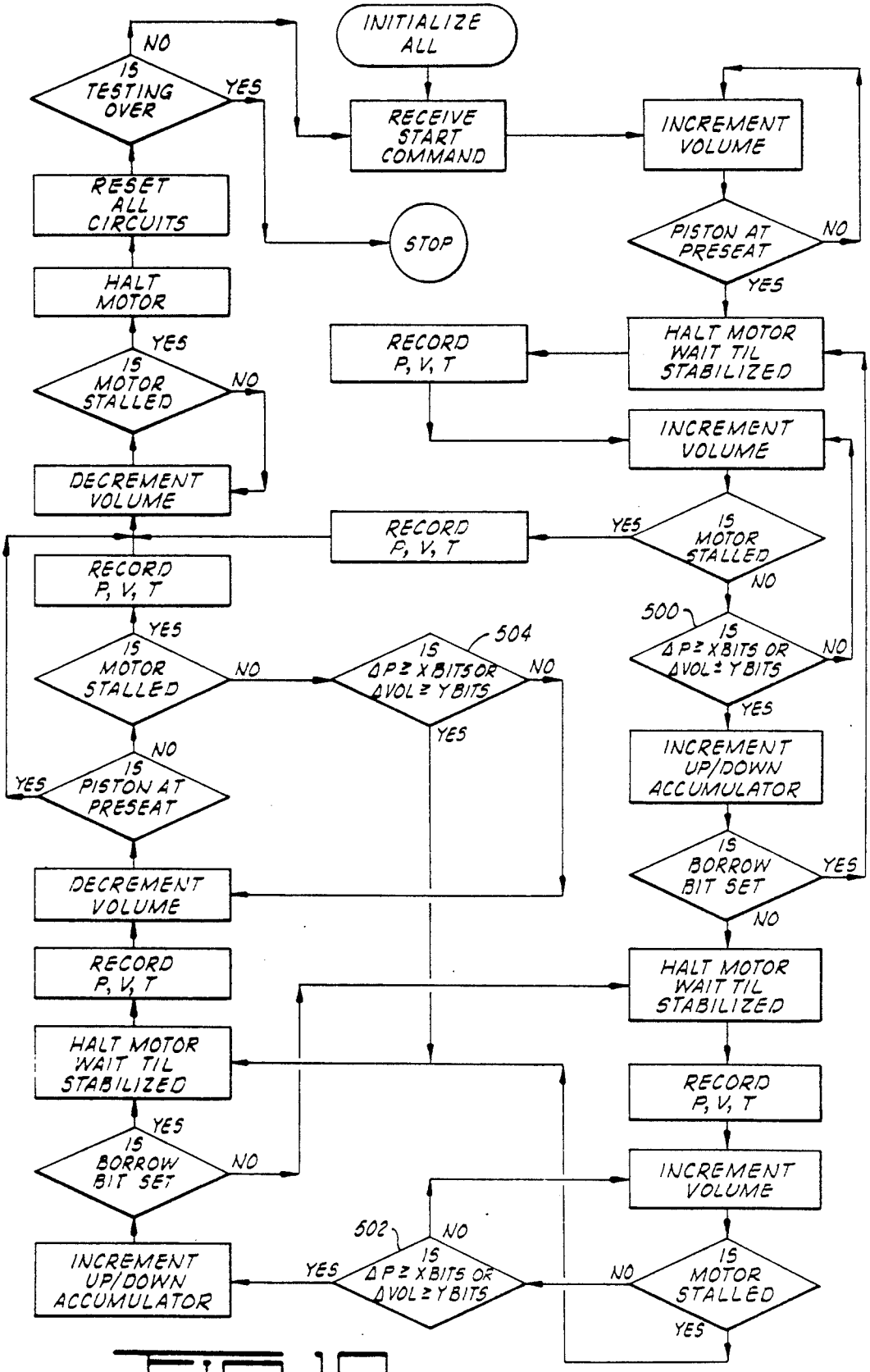
FIG. 10 a logic flow chart for the motor control circuit of FIG. 8.

FIG. 8 depicts an implementation of the motor control circuit 180 that can be used with the microprocessor-based controller 158 of the FIG. 7 embodiment so that the controller 158 can record appropriate data; however, the FIG. 8 embodiment includes two combinational logic state machines that implement the program of FIG. 6 as modified in FIG. 10. That is, the FIG. 8 embodiment off-loads from the microprocessor some of the processing ascribed to it above, thereby illustrating a variation to the previously described more fully microprocessor-based controller. FIG. 9 shows implementations of circuits for use with the FIG. 8 embodiment.

Three circuits shown in FIG. 9 are the temperature sensing circuits 142A, 228; the pressure sensing circuits 142B, 230 (the latter embodied here as a crystal controlled oscillator); and the volume/position sensing circuits 146, 314. As shown in the drawing, these circuits provide data signals to the recording bus 260 of the microprocessor-based controller of FIG. 7.

The volume oscillator circuit 314 of FIG. 9 is an LVDT (linear variable differential transformer) circuit. This circuit is used to measure volume by the position of the piston 52. The position sensor 146 is an LVDT and the circuit 314 derives a voltage coupled from the transformer 146 primary to the secondary winding. Internal compensation includes error correction for primary amplitude voltage gain control, phase error correction, temperature compensation, distortion and general noise elimination. The final stage is an RMS circuit which yields a true DC voltage value for the AC amplitude output. This in effect converts the position of the piston 52, or volume, to a proportional DC voltage.

Still referring to FIG. 9, the delta pressure circuit 232 thereof receives input from the pressure circuit 230 in the form of a square wave frequency. The signal first goes through a frequency/voltage converter 400 which converts the input frequency to a proportional voltage. This proportional voltage is further converted through an analog/digital converter 402 which produces a digital output proportional to the analog voltage input. This digital output, representing the pressure frequency, is latched into a buffer circuit which temporarily stores and outputs the input which it is provided. An EPLD circuit 404 (Electrically Programmed Logic Device) is imprinted with combinational logic so that it can compare two digital inputs (present and previous states) to each other. The EPLD circuit 404 produces two digital outputs. One output finds the difference between the two inputs to be between $-1$ bit to $+1$ bit. The other output finds the difference between the two inputs to be between $-X$ bits and $+X$ bits. The X is a design value based on dividing the absolute pressure difference required for accuracy specifications, by the resolution of the pressure circuit 230.

Again referring to FIG. 9, the delta volume circuit 300 thereof receives input from the volume oscillator 314 in the form of a RMS dc voltage. This voltage goes through a voltage/frequency converter 406 which converts the input voltage to a proportional frequency. The input RMS voltage is also converted through an analog/digital converter 408 which produces a digital output proportional to the analog RMS voltage input. This digital output, representing the volume voltage, is latched into a buffer circuit which temporarily stores and outputs the input which it is provided. An EPLD circuit 410 (Electrically Programmed Logic Device) is imprinted with combinational logic so that it can compare two digital inputs (present and previous states) to each other. The EPLD circuit 410 produces two digital outputs. One output finds the difference between the two inputs to be between $-1$ bit to $+1$ bit. The other output finds the difference between the two inputs to be between $-Y$ bits and $+Y$ bits. The Y is a design value based on dividing the absolute volume difference required for accuracy specifications, by the resolution of the volume oscillator 314.

The circuits 232 and 300 of FIG. 9 and their outputs are represented in FIG. 8, along with other aspects of the motor control circuit 180 of this embodiment. A preseat circuit 302 of the motor control circuit 180 is used to determine when the seat 104 of the valve means 100 is just prior to sealing the sample chamber 40 by closing against the fixed seat 134. This is accomplished by comparing the volume oscillator 314 output voltage with a preselected voltage establishing what is considered as preseat. These two voltages are put into a comparator of the circuit 302 which sends a positive trigger voltage level out when the preseat level has been exceeded. Likewise, when the preseat level is not exceeded, the comparator outputs no voltage at all.

A volume preparation state machine 304 comprises combinational logic capable of knowing present logical conditions and, based on logical inputs, deciding the next step in a sequence or process. The volume preparation state machine 304 receives inputs from the preseat circuit 302, the start-up initialize circuit 276, the load sense circuit 278, and the timer circuit 176. The volume preparation state machine 304 in order of occurrence: (1) presets all logic to known conditions signifying power on; (2) activates the motor 84 to assume the ready position with the piston 52 abutting the lower end of valve housing 24; (3) upon receiving input from the timer circuit 176 to start, starts the piston 52 moving in the first direction drawing in a fluid into the sample chamber 40; and (4) upon receiving input from the preseat circuit 302, halts the piston 52 movement so that the present state achieved by this sequence corresponds to the end of segment 164 on the bubble point curve 162 (FIG. 4). At this point, control is passed over to a bubble point curve state machine 306 via increment, decrement and halt control signals.

The bubble point curve state machine 306 comprises combinational logic capable of knowing present logical conditions and, based on logical inputs, deciding the next step in a sequence or process. The bubble point curve state machine 306 receives inputs from the preseat circuit 302, the delta pressure circuit 232, an up/down count accumulator circuit 308, the delta volume circuit 300, a binary counter 310, and the volume preparation state machine 304. The state machine 306 provides outputs to a steady state enable AND logic gate 312 and the motor power switching circuit 280. Through the sequence presented by FIG. 10, data will be collected throughout the bubble point curve represented in FIG. 4. The process is repeated in the reverse direction and data is collected there also. Upon completion, positioning of the piston 52 and initializing of the motor control sections 276, 304, 308, 310, and 280 are done to prepare for the next sequence.

The up/down count accumulator circuit 308 is a simple up/down counter circuit used to determine whether or not data recorded went beyond point 166 on the bubble point curve 162. It is used to determine that the number of data points collected during gas expansion 172 is equal to the number of data points collected during fluid expansion 168 of curve 162. This is to ensure an adequate number of data points to obtain with relative confidence the proper bubble point 170 of curve 162.

The binary counter circuit 310 is a simple binary counter used to identify when stable data readings have been taken before proceeding. This is done by enabling the counter 310 with the steady state enable circuit 312. When steady state 312 conditions are met, the counter 310 will increment once with every memory write cycle. This means that when a selected number of steady state data points are collected, an output going to the bubble point curve state machine 306 will signify that the piston 52 can begin movement again.

The steady state enable circuit 312 is a simple three input logical AND gate. The inputs include the +/− 1 bit from the delta pressure circuit 232, the +/− 1 bit from the delta volume circuit 300, and a RECORD P, V, T input from the bubble point curve state machine 306. All three of these inputs are required for the steady state enable output to be present.

The motor 84 is energized to move the piston 52 by directly connecting batteries to the motor through the field-effect transistors (FET) shown in FIG. 8.

The foregoing circuits of FIGS. 8 and 9, with data recording by the system of FIG. 7, implement the process shown in FIG. 10. The basic operation of FIG. 10 is apparent from the foregoing descriptions of FIGS. 5–9; however, FIG. 10 adds the steps relating to decisions 500, 502 and 504. These decisions determine whether the test is in the segment 168 or segment 172 of the graph shown in FIG. 4. If the former (wherein pressure changes are greater than volume changes), the count of the accumulator 308 is increased; if the latter (wherein volume changes are greater than pressure changes), the count is decreased. When the borrow bit of the accumulator 308 is set, an equal number of counts has occurred in both segments. In the FIG. 10 embodiment, this is done only during the sampling intake stroke of the piston 52 and not the return discharging stroke.

ALTERNATIVE TECHNIQUES FOR REMOTE CONTROL

As described above, the tool 18 set forth in FIGS. 2A–2D including the recorder/master controller 158 is controlled by the microprocessor-based control system in master controller 158. The master controller 158 may be programmed to operate in response to an internal timer as previously described or in response to remote command signals sensed by remote command sensor 178. There are many suitable techniques for communicating between the remote command station 20 and the remote command sensor 178.

One possible communication system is the use of coded pressure pulses communicated into a standing column of fluid in the well such as are described in U.S. Pat. Nos. 4,712,613 to Niewstad, 4,468,665 to Thawley, 3,233,674 to Leutwyler and 4,078,620 to Westlake.

A second remote control system which may be utilized is acoustic communication means. One suitable system for the transmission of data from a surface controller to a downhole tool utilizing acoustic communication is set forth in U. S. Pat. Nos. 4,375,239; 4,347,900; and 4,378,850 all to Barrington and assigned to the assignee of the present invention, all of which is incorporated herein by reference. The Barrington system transmits acoustic signals down a tubing string. Acoustical communication may include variations of signal frequencies, specific frequencies, or codes of acoustical signals or combinations of these. The acoustical transmission medium may include the tubing string as illustrated in the above-referenced Barrington patents, casing string, electric line, slick line, subterranean soil around the well, tubing fluid, and annulus fluid.

A third remote control system which may be utilized is radio transmission from the surface location or from a subsurface location, with corresponding radio feedback from the downhole tools to the surface location or subsurface location.

A fourth possible remote control system is the use of microwave transmission and reception.

A fifth type of remote control system is the use of electronic communication through an electric line cable suspended from the surface to the downhole control package.

A sixth suitable remote control system is the use of fiber optic communications through a fiber optic cable suspended from the surface to the downhole control package.

A seventh possible remote control system is the use of acoustic signaling from a wire line suspended transmitter to the downhole control package with subsequent feedback from the control package to the wire line suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

All of the remote control systems described above may utilize an electronic control package that is microprocessor based.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method of measuring a parameter of a hydrocarbon bearing well fluid, comprising:

(a) lowering a testing tool to a downhole location within a well;

(b) trapping a well fluid sample in said tool at said downhole location;

(c) while said tool remains within said well;

(1) expanding a volume of said trapped well fluid sample without first decreasing said volume; and (2) during step (c) (1), repeatedly measuring a pressure of said trapped well fluid sample at different volumes and thereby generating pressure versus volume data for said trapped well fluid sample; and (d) after step (c), expelling said well fluid sample from said tool back into said well by positively displacing said well fluid sample from said tool.

2. The method of claim 1, wherein said step (c) is performed while said tool remains at said downhole location.

3. The method of claim 1, further comprising:

(e) determining a bubble-point pressure of said trapped well fluid sample from said pressure versus volume data.

4. The method of claim 1, further comprising:

(e) determining compressibility of said trapped well fluid sample from said pressure versus volume data.

5. The method of claim 1, further comprising:

recording said pressure versus volume data in a recorder located within said tool.

6. The method of claim 1, further comprising:

transmitting said pressure versus volume data to a surface location for real time analysis.

7. The method of claim 1, wherein said step (b) comprises:

(b)(1) communicating a sample chamber with well fluid in said well;

(b)(2) expanding said sample chamber and thereby drawing said well fluid sample into said sample chamber; and (b)(3) isolating said sample chamber from fluid communication with said well, thereby trapping said well fluid sample within said sample chamber.

8. The method of claim 1, wherein:

said step (c)(1) includes expanding said volume of said trapped well fluid sample in incremental steps; and said method further includes monitoring the pressure of said trapped well fluid sample after each incremental step of volume increase, and allowing said pressure to stabilize prior to expanding said volume by another incremental step.

9. The method of claim 1, further comprising:

(e) after step (c) and before step (d), and while said tool remains within said well:

(1) decreasing said volume of said trapped well fluid sample; and (2) during step (e)(1), repeatedly measuring the pressure of said trapped well fluid sample and thereby generating pressure versus decreasing volume data for said trapped well fluid sample.

10. The method of claim 1, further comprising:

after said expelling step, repeating steps (b) and (c) to trap a second well fluid sample and generate pressure versus volume data for said second well fluid sample, without removing said tool from said well.

11. The method of claim 1, wherein step (c) is begun with said well fluid sample at a pressure and temperature substantially identical to well fluid in said well at said downhole location and without said well fluid sample having gone through any significant change in pressure or temperature during or after step (b) and prior to the beginning of step (c).

12. The method of claim 1, further comprising:

(e) moving said tool to another downhole location in said well; and (f) repeating steps (b), (c), (d) and (e) a plurality of times to generate said pressure versus volume data for a plurality of downhole locations with said well; and (g) determining from said data a depth in said well where gas in solution is breaking out of said well fluid.

13. An apparatus for trapping a well fluid sample and for measuring a parameter of said well fluid sample while said apparatus remains in a well, comprising:

an elongated housing having a housing bore defined therein, said housing bore partially defining a sample chamber, and said housing having a sample collection passage defined therein communicating said sample chamber with an exterior of said housing;

a piston slidably disposed in said housing bore so that a volume of said sample chamber may be expanded and a well fluid sample may be drawn into said sample chamber by movement of said piston in a first direction and so that said volume of said sample chamber may be contracted by movement of said piston in a second direction;

valve means for closing said sample collection passage and trapping said well fluid sample in said sample chamber after said piston has moved in said first direction past a first position; and sensor means, communicated with said sample chamber, for sensing a parameter of said well fluid sample.

14. The apparatus of claim 13, wherein:

said valve means is also a means for opening said sample collection passage and allowing said well fluid sample to be expelled from said sample chamber as said piston moves in said second direction.

15. The apparatus of claim 13, wherein:

said sensor means includes a pressure sensor means for sensing a pressure of said well fluid sample.

16. The apparatus of claim 15, further comprising:

piston position control means, for moving said piston in said first direction in incremental steps so that a plurality of pressure versus volume data can be generated for said well fluid sample.

17. The apparatus of claim 16, wherein:

said piston position control means includes means for monitoring the pressure of said trapped well fluid sample with said pressure sensor means, and for allowing said pressure to stabilize prior to expanding the volume of said sample chamber by another incremental step.

18. The apparatus of claim 15, further comprising:

position sensor means for sensing a position of said piston and for thereby sensing a volume of said sample chamber.

19. The apparatus of claim 18, further comprising:

means for correlating pressure measurements made with said pressure sensor means and volume measurements made with said position sensor means.

20. The apparatus of claim 13, further comprising:

an electric motor having a motor shaft;

drive means, operably connecting said electric motor and said piston, for translating rotation of said motor shaft into movement of said piston in said first and second directions;

position sensor means for sensing a value representative of a volume of said sample chamber; and control means for controlling the operation of said electric motor.

21. The apparatus of claim 20, wherein said control means is microprocessed based.

22. The apparatus of claim 20, wherein:

said position sensor means is a linear position sensor means for sensing a position of said piston relative to said housing.

23. The apparatus of claim 20, wherein:

said sensor means is a pressure sensor.

24. The apparatus of claim 23, further comprising:

a temperature sensor for measuring the temperature of said well fluid sample; and recorder means for recording and correlating pressure, temperature and volume data from said pressure sensor, said temperature sensor and said position sensor means.

25. An apparatus for trapping a well fluid sample and for measuring a parameter of said well fluid sample while said apparatus remains in a well, comprising:

an elongated housing having a housing bore defined therein, said housing bore partially defining a sample chamber, and said housing having a sample collection passage defined therein communicating said sample chamber with n exterior of said housing;

a piston slidably disposed in said housing bore so that a volume of said sample chamber may be expanded by movement of said piston in a first direction and so that said volume of said sample chamber may be contracted by movement of said piston in a second direction;

valve means for closing said sample collection passage and trapping a well fluid sample in said sample chamber after said piston has moved in said first direction past a first position;

sensor means, communicated with said sample chamber, for sensing a parameter of said well fluid sample; and piston position control means for moving said piston in said first direction and stopping said piston prior to said piston reaching said first position where said valve means closes, and for then further moving said piston in said first direction in incremental steps while allowing pressure in said sample chamber to stabilize between steps so that said valve means closes trapping said sample and so that a volume of said trapped sample is then incrementally increased.

26. An apparatus for trapping a well fluid sample and for measuring a parameter of said well fluid sample while said apparatus remains in a well, comprising:

an elongated housing having a housing bore defined therein, said housing bore partially defining a sample chamber, and said housing having a sample collection passage defined therein communicating said sample chamber with n exterior of said housing;

a piston slidably disposed in said housing bore so that a volume of said sample chamber may be expanded by movement of said piston in a first direction and so that said volume of said sample chamber may be contracted by movement of said piston in a second direction;

valve means for closing said sample collection passage and trapping a well fluid sample in said sample chamber after said piston has moved in said first direction past a first position;

sensor means, communicated with said sample chamber, for sensing a parameter of said well fluid sample;

spring biasing means for biasing said valve means in said first direction; and wherein said valve means includes a valve stem which abuts said piston so that said valve stem follows said piston as said piston travels in said first direction until said valve means closes said sample collection passage.

* * * * *